US012674402B2

(12) United States Patent
Juchymenko

(10) Patent No.: US 12,674,402 B2
(45) **Date of Patent: *Jul. 7, 2026**

(54) PROCESSOR-BASED ORGANIC RANKINE CYCLE SYSTEM FOR PREDICTIVELY-MODELED RECOVERY AND CONVERSION OF THERMAL ENERGY

(71) Applicant: Victor Juchymenko, Calgary (CA)

(72) Inventor: Victor Juchymenko, Calgary (CA)

( * ) Notice: Subject to any disclaimer, the term of this patent is extended or adjusted under 35 U.S.C. 154(b) by 0 days.

This patent is subject to a terminal disclaimer.

(21) Appl. No.: 18/923,628

(22) Filed: Oct. 22, 2024

(65) Prior Publication Data

US 2025/0101887 A1 Mar. 27, 2025

Related U.S. Application Data

(63) Continuation of application No. 17/183,283, filed on Feb. 23, 2021, now Pat. No. 12,123,325, which is a (Continued)

(51) Int. Cl.
*F01K 23/06* (2006.01)
*F01K 13/00* (2006.01)
(Continued)

(52) U.S. Cl.
CPC ..... *F01K 23/065* (2013.01); *F01K 13/00* (2013.01); *F01K 13/02* (2013.01); *F01K 23/101* (2013.01); *F01K 25/08* (2013.01); *F01K 27/02* (2013.01)

(58) Field of Classification Search
CPC ..... F01K 23/065; F02D 2041/1412
See application file for complete search history.

(56) References Cited

U.S. PATENT DOCUMENTS 4,622,472 A 11/1986 Bronicki
12,123,325 B2 * 10/2024 Juchymenko ..... F01K 23/101
(Continued)

FOREIGN PATENT DOCUMENTS

CN 103742293 A 4/2014
DE 102010048887 A1 4/2012
WO 2019086960 A1 5/2019

OTHER PUBLICATIONS

PCT/IB2018/001404. International Search Report & Written Opinion (Apr. 8, 2019).

*Primary Examiner* — Laert Dounis
(74) *Attorney, Agent, or Firm* — LOZA & LOZA, LLP; Peter Zura

(57) ABSTRACT

Technologies and techniques for converting thermal energy into mechanical and/or electric energy using an integrated thermal energy recovery system. This system employs an Organic Rankine Cycle (ORC) with a propellant heat exchanger, an expander, and a condenser, coupled with heat exchangers for transferring waste heat from an engine to ORC propellant. Sensors generate data reflecting environmental and operational conditions. A control circuit, incorporating a predictive module trained on a neural network, identifies non-linear relationships and sequences for optimizing ORC performance. The control circuit analyzes sensor data to determine if target operational values for waste heat recovery and power generation can be achieved within a specific timeframe. If not, the circuit dynamically adjusts the system via control signals to optimize net power by managing heat flow between thermal fluids, engine jacket water, engine exhaust, and/or ORC propellant to maintain target values.

20 Claims, 15 Drawing Sheets

Related U.S. Application Data continuation-in-part of application No. 16/761,492, filed as application No. PCT/IB2018/001404 on Nov. 5, 2018, now Pat. No. 11,401,837.

(60) Provisional application No. 62/581,578, filed on Nov. 3, 2017.

(51) Int. Cl.

| | |
|---|---|
| ***F01K 13/02*** | (2006.01) |
| ***F01K 23/10*** | (2006.01) |
| ***F01K 25/08*** | (2006.01) |
| ***F01K 27/02*** | (2006.01) |

(56) References Cited

U.S. PATENT DOCUMENTS

| | | | |
|---|---|---|---|
| 2002/0016656 | A1 | 2/2002 | Chung et al. |
| 2004/0016419 | A1 | 1/2004 | Satou et al. |
| 2009/0320477 | A1 | 12/2009 | Juchymenko |
| 2011/0225972 | A1 | 9/2011 | Bruckner et al. |
| 2013/0133321 | A1 | 5/2013 | Ringler et al. |
| 2015/0185716 | A1 | 7/2015 | Wichmann et al. |

* cited by examiner

PROCESSOR-BASED ORGANIC RANKINE CYCLE SYSTEM FOR PREDICTIVELY-MODELED RECOVERY AND CONVERSION OF THERMAL ENERGY

RELATED APPLICATIONS

The present application is a continuation of U.S. patent application Ser. No. 17/183,283 filed Feb. 23, 2021 entitled PROCESSOR-BASED ORGANIC RANKINE CYCLE SYSTEM FOR PREDICTIVELY-MODELED RECOVERY AND CONVERSION OF THERMAL ENERGY, now U.S. Pat. No. 12,123,325 issued Oct. 22, 2024, which is a continuation-in-part of U.S. patent application Ser. No. 16/761,492, filed May 4, 2020 entitled "SYSTEM, APPARATUS AND METHOD FOR MANAGING HEAT TRANSFER IN POWER GENERATION SYSTEMS, now U.S. Pat. No. 11,401,837 issued Aug. 2, 2022, which is a U.S. 371 national stage of PCT International Pat. App. No. PCT/IB2018/001404 filed Nov. 5, 2018, which claims priority to U.S. Provisional App. No. 62/581,578, filed Nov. 3, 2017, the contents of each being incorporated by reference in their entirety herein.

The present application is also related to U.S. patent application Ser. No. 13/961,341, titled "Controlled Organic Rankine Cycle System for Recovery and Conversion of Thermal Energy" to Victor Juchymenko filed Aug. 7, 2013, now U.S. Pat. No. 9,683,463 issued Jun. 20, 2017, the contents of which is incorporated by reference in its entirety herein.

TECHNICAL FIELD

The present invention relates generally to thermal energy recovery systems. More particularly, the present invention relates to a system for recovering thermal energy from a reciprocating engine and converting the thermal energy to secondary power through controlled operation of an organic Rankine cycle system.

BACKGROUND

Methods for implementing a Rankine cycle within a system to recover thermal energy from an engine are well known. Although these systems were initially developed to produce steam that could be used to drive a steam turbine, the basic principles of the Rankine cycle have since been extended to lower temperature applications by the use of volatile organic chemicals as propellants with the system. Such organic Rankine cycles (ORCs) are typically used within thermal energy recovery systems or geothermal applications, in which heat is converted into secondary mechanical energy that can be used to generate electrical energy. As such, these systems have become particularly useful in heat recovery and power generation—collecting heat from turbine exhaust gas, engines, combustion processes, geothermal sources, solar heat collectors, and thermal energy from other industrial sources. Organic Rankine cycles are generally most useful within temperature ranges from 158 to 752 degrees F., and are most often used to produce power between 250 kW and 5000 kW of power.

Generally, a Rankine-based heat recovery system includes a propellant pump for driving propellant through the system, an evaporator for evaporating propellant that has become heated by collection of waste heat, a turbine through which evaporated propellant is expanded to create power or perform work, and a condenser for cooling the propellant back to liquid state so it may be pumped to collect heat again and repeat the cycle. The basic Rankine cycle has been adapted for collection of heat from various sources, with conversion of the heat energy to other energy outputs.

For example, U.S. Pat. No. 5,440,882 describes a method for using geothermal energy to drive a modified ORC based system that uses an ammonia and water mixture as the propellant. The evaporated working fluid is used to operate a second turbine, generating additional power. Heat is conserved within the Rankine cycle portion of the system through the use of a recuperator heat exchanger at the working fluid condensation stage.

U.S. Pat. No. 6,986,251 describes a Rankine cycle system for extracting waste heat from several sources in a reciprocating engine system. A primary propellant pump drives the Rankine cycle with assistance from the auxiliary booster pump, to limit pump speeds and avoid cavitation. When the Rankine cycle is inactive (e.g. due to reciprocating engine failure or maintenance), the auxiliary pump operates alone, circulating propellant until the propellant and system components have cooled sufficiently for complete shut down. Diversions are present to prevent circulation of propellant through the evaporator and through the turbine during this cooling cycle.

U.S. Pat. No. 4,228,657 describes the use of a screw expander within a Rankine cycle system. The screw expander is used to expand a thermodynamic fluid, and waste heat is further extracted from the expander in order to improve system efficiency. A geothermal well supplies pressurized hot water or brine as the heat source.

When using organic propellants within a Rankine cycle, care must be taken to avoid exposure of the propellants to flame. Although specialized organic propellants having high flash temperatures (for example Genetron™ R-245fa, which is 1,1,1,3,3-pentafluoropropane) have been developed, the danger of combustibility still exists, as engine exhaust may reach temperatures up to 1200 degrees F. A leak in an exhaust heat exchanger could therefore be disastrous. Further, the purchase of proprietary propellants adds a significant start-up cost to these systems.

A common problem particularly relevant to recovery of thermal energy is that when using air-cooled condensers, ambient air temperatures significantly impact the system efficiency and total power available. Furthermore, technologies and techniques are needed to allow a thermal energy recovery system to adapt to environmental changes within and around the system. Such technologies and techniques should also include predictive features to allow the system to anticipate when system adjustments (e.g., flow rate, fan circulation, fluid distribution) are necessary to bring the system to operate at a specific range of performance targets.

SUMMARY

It is an object of the present invention to obviate or mitigate at least one disadvantage of previous Rankine-based heat recovery systems.

In some illustrative embodiments, there is provided a system for controlled recovery of thermal energy from a reciprocating engine and conversion of said thermal energy to mechanical energy, the system comprising: a reciprocating engine operable to provide a primary power source; a circulating pump, at least one heat exchanger, an expander, and a condenser, arranged to operate an organic Rankine cycle in which thermal energy is collected from the engine and is transferred to a liquid organic propellant in the propellant heat exchanger in the ORC to evaporate the propellant, which gaseous propellant then drives the expander in production of mechanical energy to create a secondary power source, with propellant from the expander condensed back into liquid form by the condenser for reuse within the organic Rankine cycle; a monitoring module for sensing system operating conditions including at least one of: temperature; pressure; and flow of organic propellant, at one or more locations within the Rankine cycle; and a control module for acquiring and processing information received from the monitoring module, and for regulating operation of the system based on said information to optimize power generation of the secondary power source. The secondary power source may be operatively connected to the engine to provide supplementary power, for example by powering some or all of the parasitic loads of the primary power source or by providing electric power to the facility to displace primary or tertiary power being consumed on site. The supplementary/secondary power may be provided as mechanical shaft horsepower or electric power.

In some illustrative embodiments, thermal energy is collected from the reciprocating engine by circulation of fluid about the engine jacket, which thermal energy is then transferred from the jacket fluid to the organic propellant at the heat exchanger. In this embodiment, the control module may regulate the flow of jacket fluid between the engine and the heat exchanger to control the amount of thermal energy collected from the engine for use within the Rankine cycle. A jacket fluid diverter valve may be provided to control direction of engine jacket fluid to either the jacket fluid heat exchanger or to the engine radiator. The control module may regulate operation of this valve to control the amount of flow, and thus thermal energy, transferred to the organic propellant. In certain embodiments, the jacket fluid disclosed herein may be water, glycol, or a combination of water and glycol. Suitable thermal fluids may be water, glycol, or a combination of water and glycol, mineral based thermal oils or synthetic thermal fluids.

Additional thermal energy may also be collected from the reciprocating engine exhaust by circulation of thermal fluid about a thermal fluid heat exchanger within the reciprocating engine exhaust system, with said additional thermal energy transferred to the organic propellant at a second propellant heat exchanger. The thermal fluid is any suitable fluid, for example, one comprising water, glycol, water-glycol blend, mineral-based thermal oil, or synthetic thermal fluid (such as a "heat transfer fluid" or a "thermal oil"). An exhaust diverter valve may be present and may be regulated by the control system to control the amount of thermal energy transferred to the organic propellant.

In some illustrative embodiments, thermal energy is collected from the reciprocating engine by circulation of thermal fluid about a thermal fluid heat exchanger within the engine exhaust system, which thermal energy is then transferred from the thermal fluid to the organic propellant at the propellant heat exchanger. The thermal fluid may be any suitable fluid such as a mineral based oil or a synthetic thermal fluid. While some ORC system configurations may be configured to divert all of the available heat from a heat source, other configurations are envisioned in the present disclosure, where an intelligent control module (e.g., applying predictive models) does not divert all available heat, in order to achieve predetermined performance parameters. The system could also monitor the exhaust stack temperature in order to maintain enough thermal energy in the exhaust stream to prevent condensates from forming in the exhaust stream. Therefore, the maximum amount of heat can be extracted from the exhaust stream, without causing condensates. If the exhaust system has been designed to handle condensates (for example to handle the corrosiveness and collection of the condensate) then the control module can control the exhaust diverter valve (whether on temperature or other mechanism) to control how much heat is recovered from that energy stream.

In some embodiments, the control module may further include an exhaust diverter valve for venting exhaust gas to atmosphere. The control module regulates operation of the diverter valve and may further regulate thermal fluid flow by regulating the thermal fluid circulating pump to control the amount of thermal energy transferred to the thermal fluid for subsequent exchange with organic propellant at the propellant heat exchanger.

In another embodiment, the monitoring module comprises sensors throughout the ORC system which may include, but are not limited to, a sensor at the expander inlet and/or outlet, and/or at the condenser inlet and/or outlet, and/or evaporator, and/or thermal fluid system, and/or jacket water recovery system, which may be speed, flow, valve position, electric load/resistance, temperature and/or pressure sensors or relay/switch position settings. The monitoring module may also include an ambient air temperature sensor. The monitoring and control module may co-exist as/in a single unit.

In a suitable embodiment, the control module includes a processor for processing data received from the monitoring module to determine the operating conditions within the ORC, the physical state of the various fluids and/or propellant, components/equipment and the ambient air temperature at monitored locations within the system. Comparisons may be made to previously simulated performance data in order to determine appropriate adjustments to the system. The control module may adjust at least one of: the heat transfer from the engine to the ORC propellant; the heat removed by the condenser; the flow rate of engine exhaust; the flow rate of engine water/glycol; the flow rate of thermal fluids; the flow rate of ORC organic propellant; propellant temperature; and propellant pressure within the system in response to said data processing.

In some illustrative embodiments, a motor control center receives electric power and supplies the electric power to the ORC system and connected site loads, on demand. The motor control center may receive power from the primary, secondary, and tertiary power sources.

The monitoring module may further monitor on-site power demand, with the control module responding to the monitored power demand to establish appropriate power consumption to system components accordingly.

In certain embodiments, the condenser is air cooled and includes a fan or multiple fans for cooling propellant at the condenser, and the control module may adjust the number of fans to be operating and/or the speed of the fan(s) based on monitored operating conditions. The fan(s) may also be located proximal to a jacket fluid radiator such that the fan simultaneously blows air across the radiator and the condenser.

In other embodiments, the condenser is liquid cooled and includes cooling fluid for circulation about propellant conduits by a circulating pump, and the control module may adjust the rate of circulation of cooling water about the propellant conduits based on monitored operating conditions. The engine radiator may be located proximal to the organic propellant condenser such that the circulating pump simultaneously cools engine jacket fluid within the radiator and propellant within the condenser.

In an embodiment, the reciprocating engine powers a natural gas compression module. A boost compressor may further be present, powered by secondary power generated by the expander, for example by mechanical shaft horsepower from the expander, or by electric power generated by the expander.

The natural gas compression module may comprise a cooling module to remove heat from the natural gas after each stage of gas compression. The cooling module may include a fan(s) controlled by the control module based on ambient air temperatures, natural gas temperatures (after being compressed), flow rate of natural gas, radiator fluid temperatures (when the radiator is co-located with the gas coolers, sharing the same fan(s)), and cooling fluid temperatures when the gas is cooled in a liquid to gas heat exchanger.

The fan(s) may receive tertiary electric power; secondary power, which may be provided as mechanical shaft horsepower; or electrical power or primary power, which may be provided as mechanical shaft horsepower or electrical power to turn the fan(s).

In certain embodiments, thermal energy generated during compression of natural gas may be transferred to the organic propellant for use within the organic Rankine cycle.

In suitable embodiments, an electric fan(s) may be used to cool one or more of: organic propellant within the condenser conduits; radiator fluid within the engine radiator; and natural gas within the natural gas conduits. Any two or more of these components may be co-located to permit cooling by electric fan(s) regulated by the control module based on monitored parameters.

In an embodiment of the invention, the expander is a screw expander. The screw expander produces mechanical shaft power, which may be used to power a compressor, a pump or a generator. In either scenario, the speed control module may regulate operation of the screw expander through use of a throttle valve.

The ORC system may further comprise a diverter valve and bypass loop for diverting organic propellant around the expander for pressure relief, reduction in pressure differential across the expander, and/or when the organic propellant is in saturated or liquid form, and the control module may activate the diverter valve to divert propellant around the expander during operation, start-up and shutdown of the organic Rankine cycle.

In an additional embodiment, there is further provided a recuperator for recovering thermal energy from organic propellant exiting the expander, which thermal energy is used to pre-heat organic propellant exiting the condenser or propellant storage tank/vessel.

In a further embodiment, the control module further monitors and allocates operational control that effects power consumption to system components as needed. The control module may dispatch a tertiary power source for allocation of tertiary power to the site.

In certain embodiments, secondary power produced by the ORC may be mechanically coupled to a gas compressor, an electric generator, or a fluid pump.

In some illustrative embodiments, there is provided a system for providing power at a remote site comprising: a reciprocating engine for providing a primary electric power output (typically referred to as a genset); a Rankine cycle for collecting waste energy from the reciprocating engine and converting said waste energy to secondary power output; a tertiary power source whether that being a TEG or grid power or other source of power; a control module, a monitoring module including a power demand module for sensing power demanded at the remote site and for communicating with the control module to activate the tertiary power source when the primary and secondary power outputs are not sufficient to meet the power demand. If no power export capability is an option but battery charging capability exists on site, then that surplus power can be used to charge batteries. Power output from the primary and secondary power sources may also be monitored and controlled by the control module and a tertiary power source may also be recruited by the control module as necessary to provide supplementary power. Meaning, because it is a remote site, there is no external grid connection to provide site power, and thus all power generated on the site is to be consumed on the site. Power generation typically follows the load and generates power to meet the demands of the load. In a case where you have a genset operating and an ORC recovering heat from the gensets engine to produce power, the load following nature of the genset needs to take into account the power being generated by the ORC. Thus a smart artificial intelligence control module would predict the amount of power that would be generated by both the genset and the ORC to meet the sites load. Some intelligence is required in this control because the combination of the two systems together could spiral up or down and simple logic would have the system "chasing its own tail in circles".

Tertiary power may be grid power or a generator, for example, and the primary power source may also be a generator.

Other aspects and features of the present invention will become apparent to those ordinarily skilled in the art upon review of the following description of specific embodiments of the invention in conjunction with the accompanying figures.

BRIEF DESCRIPTION OF THE FIGURES

Embodiments of the present invention will now be described, by way of example only, with reference to the attached Figures, wherein.

DETAILED DESCRIPTION

Figure 1:
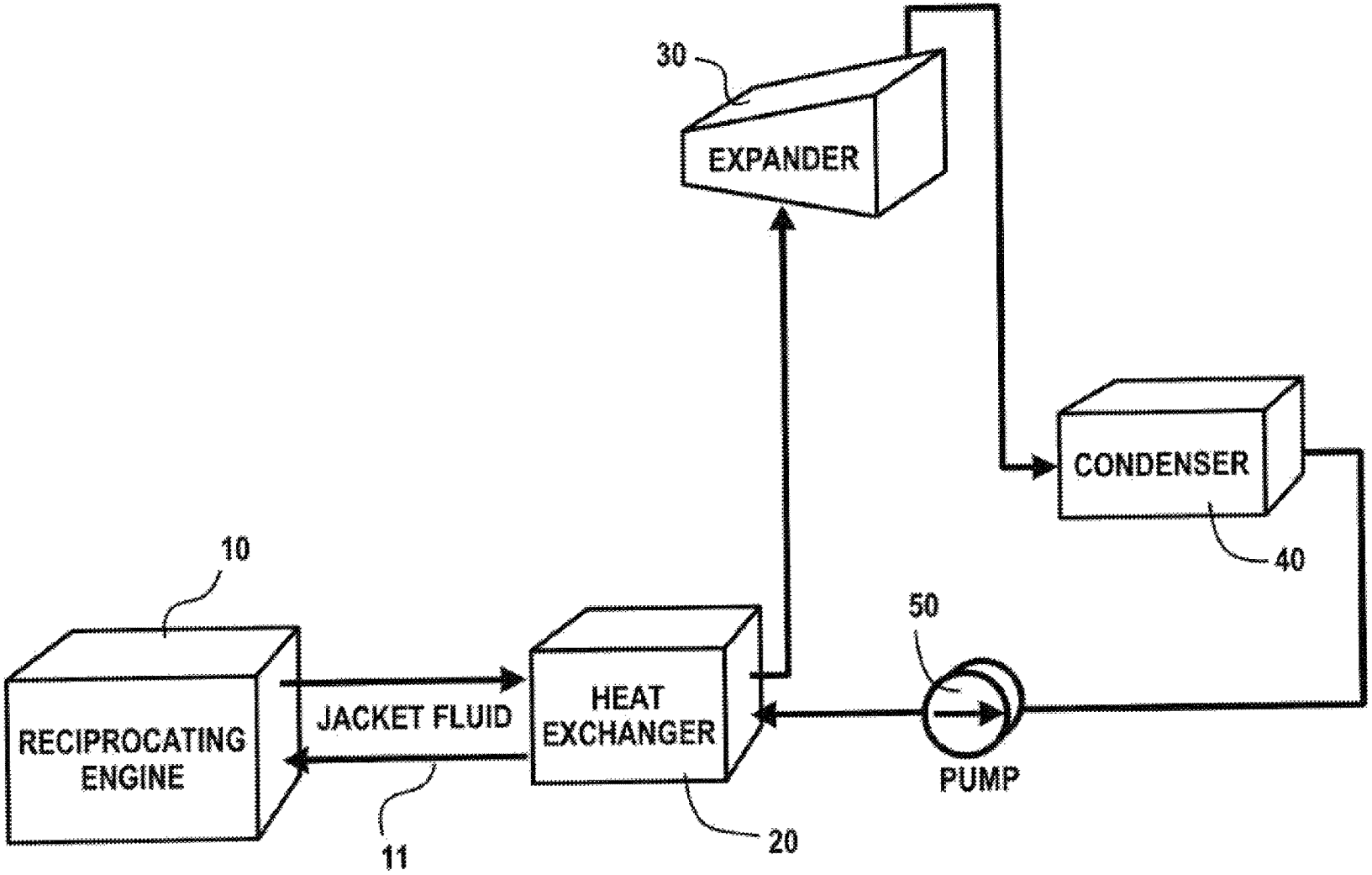
FIG. 1 is a simplified thermal energy recovery system under an illustrative embodiment.

Generally, the present invention provides a method and system to recover thermal energy from a reciprocating engine by operation of an associated organic Rankine cycle ("ORC") and or Thermoelectric Generator ("TEG") to produce a secondary power source, as the case may be. In operation of the ORC and/or TEG, a monitoring module senses one or more system parameters such as flow, energy draw of parasitic loads, pressure, and/or temperature, parasitic loads, as well as ambient air temperature, and a control module adjusts operation of the system as needed to maximize output from the secondary power source.

Incorporating an ORC system with a Thermo-Electric Generator (TEG), for example, to recover waste heat from a reciprocating engine, can provide additional advantages. Specifically, by transferring different grades and types of heat from the reciprocating engine to the TEG and/or the ORC system, in the various equipment combinations and embodiments discussed in greater detail below, the overall efficiency of the reciprocating engine, the TEG and the ORC system can be improved because TEG requires high grade heat whereas an ORC system may only require heat in the 175° F. (and higher) range to make economic power. Both systems operating together can capture and utilize the reject heat from an engine more efficiently, and when the reject heat between the ORC and TEG are shared between each other, the efficiencies are even higher. Specifically, the heat rejected by the reciprocating engine's exhaust can be used to generate power in a TEG. The engine exhaust rejected to the TEG first and then recovered for use in an ORC system to generate more power. The engines discharge jacket water contains energy that can be used in an ORC system. Combining these heat streams and moving them between one another can produce a more efficient use of energy. Such a configuration may advantageously recover useable thermal energy and place it in optimal locations such that it improves the overall efficiency of the system. Heat rejected by the reciprocating engine can be used to power a TEG and/or an ORC or in application of low-grade heat such as district heating, building heating, heat tracing of pipes, etc. Additionally, heat rejected by the TEG can be used in an ORC system, and rejected heat from the TEG and ORC can be used, in certain illustrative embodiments, for low-grade uses such as district heating, building heating, process applications, bulk material drying, heat tracing of pipes, etc.

A heat transfer process may begin with fuel combustion in a diesel or spark ignition engine, which may be powered by bio-diesel, natural gas, propane, gasoline, and/or diesel fuel, and the like. During operation, an engine may emit exhaust and radiant heat into the engines jacket water that may have that energy dissipated through the use of an air cooled (or other suitable) radiator. Other engine rejected heat may be dissipated via the lubricant and/or auxiliary cooling system (e.g., turbo intercooling) and can be used in a similar manner described herein, provided its temperature fits into the ORC system or the TEG or for other purposes. An ORC system can use rejected waste heat from any source to pre-heat, evaporate or superheat the working fluid (also known as propellant) and therefore insertion of that waste heat into locations in the ORC process where the working fluid (propellant) is at a lower temperature than the waste heat, is desired.

It will be understood that the structural and algorithmic embodiments as used herein does not limit the functionality to particular structures or algorithms, but may include any number of software and/or hardware components. In general, a computer program product in accordance with one embodiment comprises a tangible computer usable medium (e.g., hard drive, standard RAM, an optical disc, a USB drive, or the like) having computer-readable program code embodied therein, wherein the computer-readable program code is adapted to be executed by a processor (working in connection with an operating system) to implement one or more functions and methods as described below. In this regard, the program code may be implemented in any desired language, and may be implemented as machine code, assembly code, byte code, interpretable source code or the like (e.g., via Scala Programming Language (Scala), C, C++, C #, Java, Actionscript, Objective-C, Javascript, CSS, XML, Linux, etc.). Furthermore, the term "information" as used herein is to be understood as meaning digital information and/or digital data, and that the term "information" and "data" are to be interpreted as synonymous.

In the embodiments illustrated in FIGS. 1 through 9, flow of organic propellant within the Rankine cycle is driven by a speed-controllable pump, with gaseous organic propellant passing through an expander 30 to generate the secondary power source, condensing the propellant and then restarting the process back at the pump. In some embodiments, propellant exiting the expander is passed through a recuperator to recover thermal energy. The propellant is then condensed by passage through a condenser 40 (which may be air-cooled or liquid-cooled), followed by recovery of thermal energy from the recuperator. The preheated propellant returns to the heat exchanger(s) to collect engine heat, converting the propellant again to gaseous state to be passed through the expander. The process is a closed loop system and the above described process repeats.

Secondary power may be produced by a TEG or by the ORC where the expander as electricity or as mechanical shaft horsepower, and this secondary power may be used to directly operate other site equipment, may feed into a motor control center to be used on site, or may directly supplement primary power generated.

A tertiary power source may also be present to supplement site power as necessary. The tertiary power source may be fed into a motor control center to ensure that on-site power demands are met. The tertiary, primary and secondary power sources may operate together to meet the demands of the site which they are connect to or installed on.

System Overview

With reference to FIG. 1, a simplified thermal energy recovery system in accordance with an embodiment of the invention is shown. Reciprocating engine 10 provides a primary power source, and in addition releases thermal energy through engine exhaust and as radiant energy. The radiant energy is dissipated from the engine block by heat transfer within the engine jacket (housing) to a cooling fluid circulating within the engine jacket. The thermal energy collected by the jacket fluid 11 (typically a glycol and water mixture) is transferred to organic propellant within the Rankine cycle through heat exchanger 20. The liquid organic propellant is thereby evaporated and pushed through the expander 30 to generate a secondary source of power. Propellant leaving the expander is condensed at condenser 40 and passes through a pump 50 prior to returning to the heat exchanger 20 to repeat the Rankine cycle. A monitoring module and a control module 100, although not shown in all Figures, is included in each system described below to regulate various components and functions, as will be described. The monitoring module and control module 100 may be configured as separate components, or may be integrated as a single unit. Further details regarding control module 100 are discussed below in connections with FIGS. 10-13. The term "control module" or any other "module" as used herein may be synonymously be described as a "control circuit" or simply "circuit" (e.g., monitoring circuit).

Figure 2:
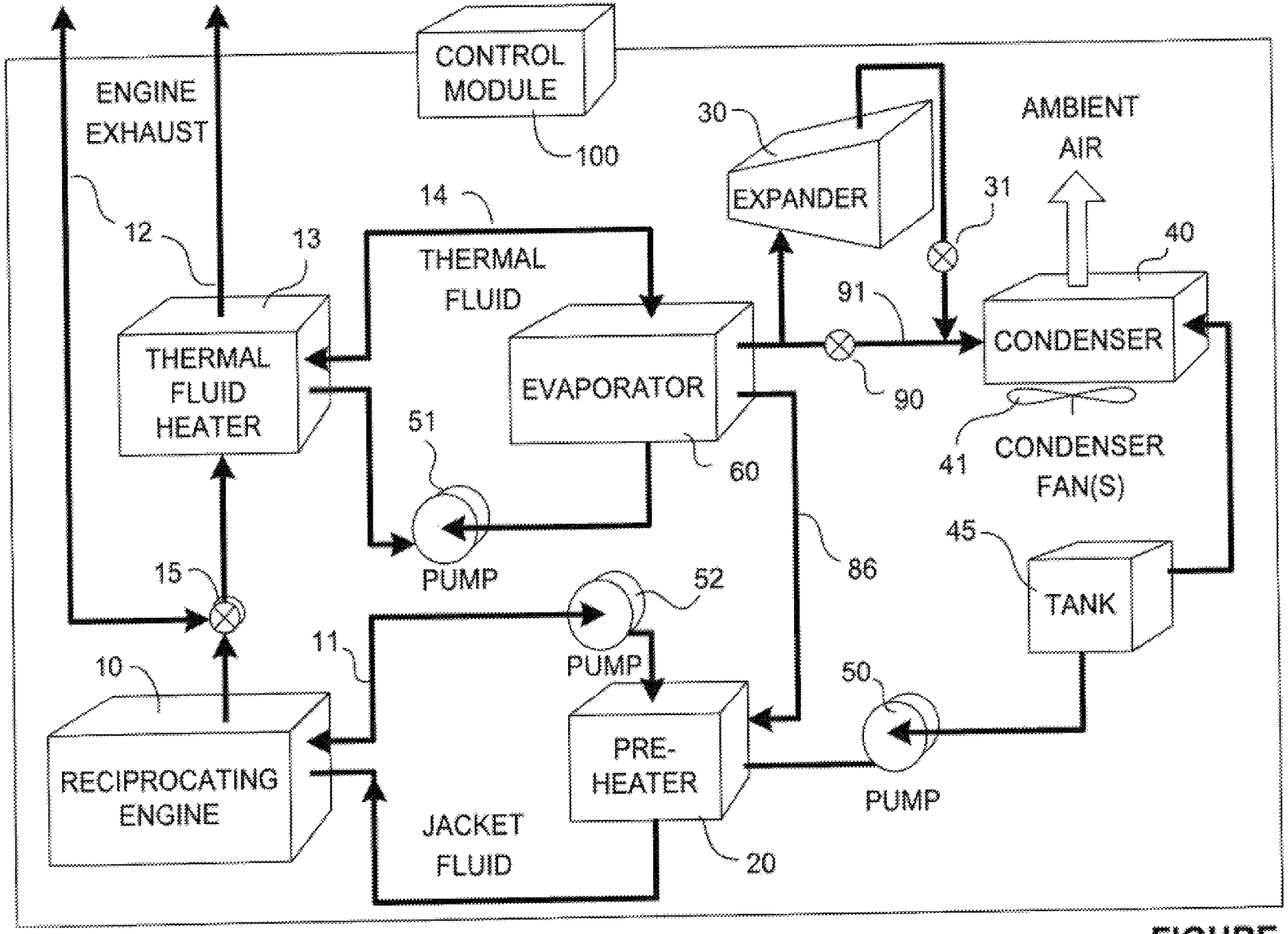
FIG. 2 is another simplified thermal energy recovery system under an illustrative embodiment.

With reference to FIG. 2, a further system design is shown in accordance with an illustrative embodiment. Thermal energy is collected from engine jacket fluid 11, which thermal energy is transferred to organic propellant at heat exchanger 20. The preheated organic propellant may collect additional thermal energy from engine exhaust 12, through heat exchange with a thermal fluid circulating to and from the exhaust system, at evaporator 60. The use of a thermal heating fluid is preferred in collection of thermal energy from the engine exhaust 12 (which exhaust may reach temperatures in excess of the propellant flash temperature) to minimize the risk of fire or explosion. Further, the thermal fluid loop allows the ORC system to be located a reasonable distance from the reciprocating engine, as thermal fluid may easily be pumped through a piping system (insulated pipes in cold climates) with minimal thermal losses. As such, thermal energy from engine exhaust 12 is directed either to atmosphere or to the thermal fluid heater 13 by diverter valve 15. Thermal energy collected in the thermal heating fluid is transferred to organic propellant 86 at evaporator 60, with gaseous propellant passing to the expander 30, driving generation of secondary power. The spent propellant then passes to the condenser 40, and exits the condenser in liquid form to be returned to heat exchanger 20, and repeat the cycle. Although not shown in this figure, once the propellant is condensed into liquid, it is temporarily held in a storage vessel before being pumped to the heat exchanger 20.

System Operation

Figure 3:
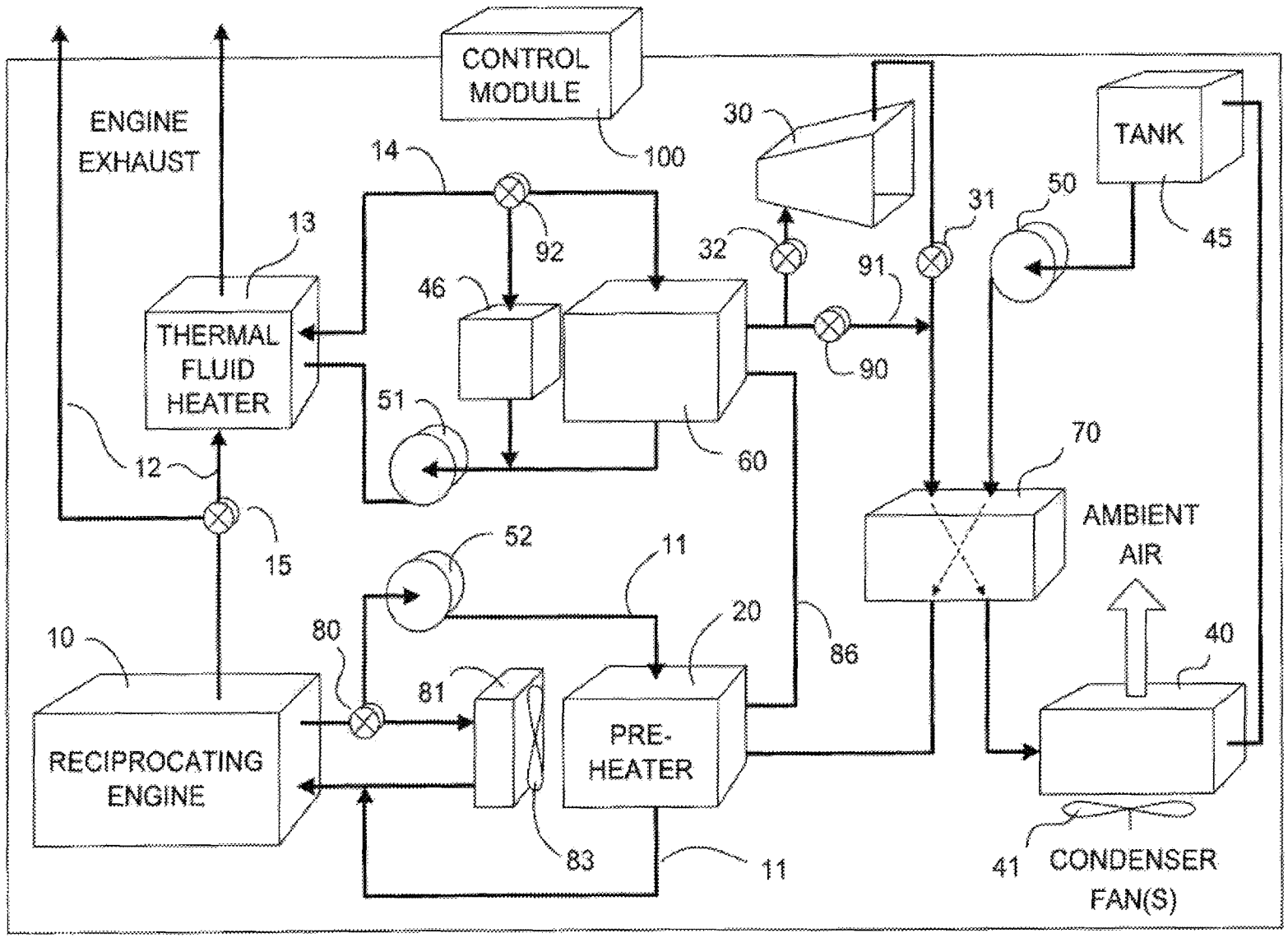
FIG. 3 is yet another simplified thermal energy recovery system under an illustrative embodiment.

Referring now to FIG. 3, which depicts a specific embodiment of the invention, a recuperator 70 exchanges thermal energy from the propellant exiting the expander 30 with cooled propellant from the condenser 40 or storage tank 45, preheating the liquid propellant before it reaches the pre-heater 20 which exchanges thermal energy between the engine jacket and the propellant.

Figure 10:
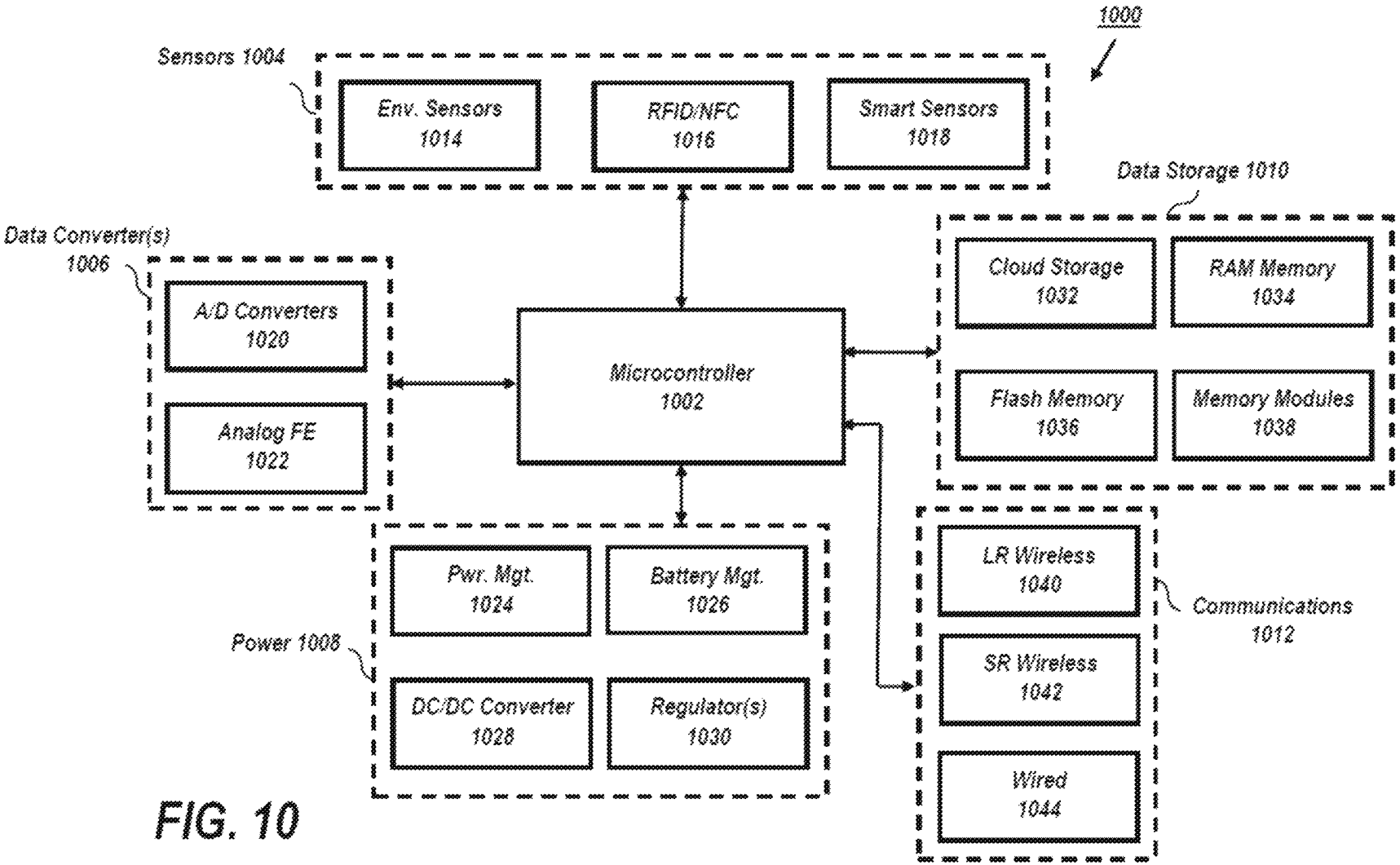
FIG. 10 is a simplified block diagram of a control module for use in an energy recovery system under an illustrative embodiment.
Figure 11:
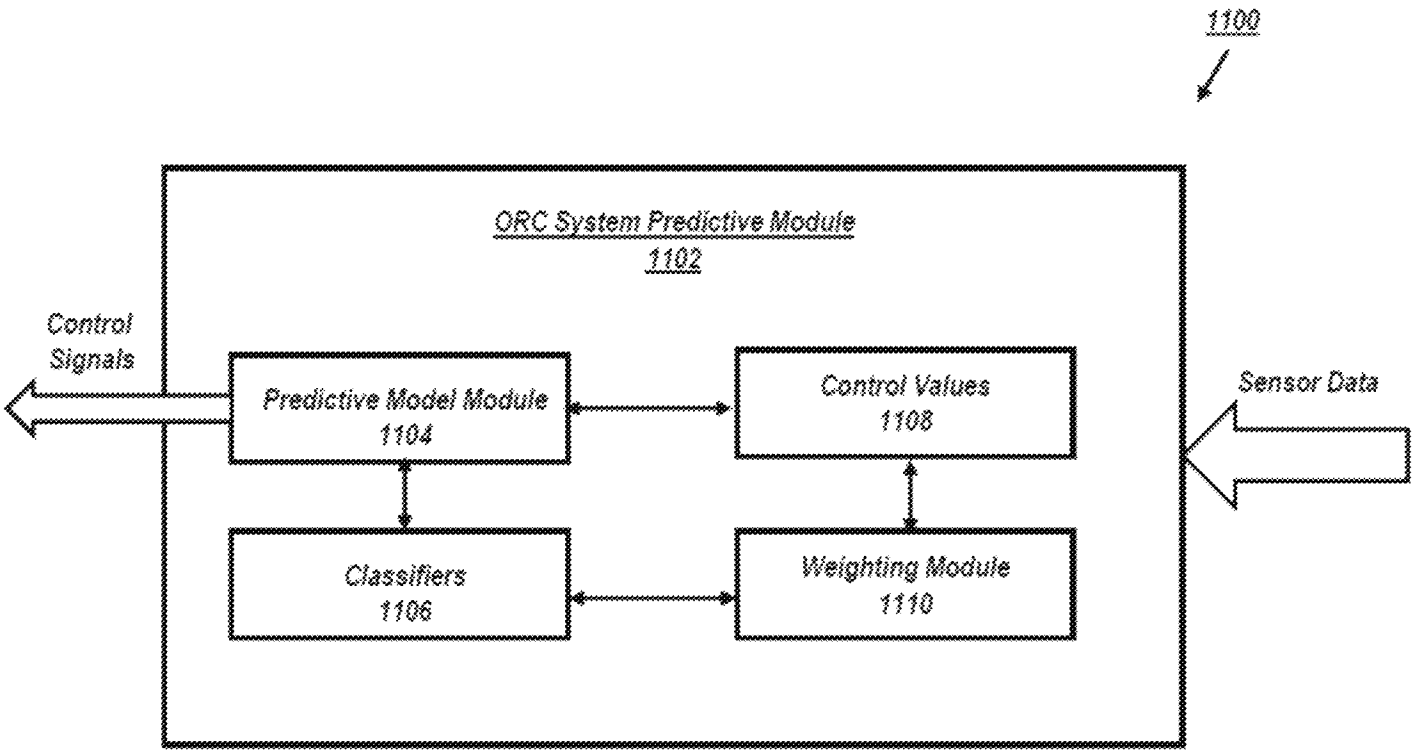
FIG. 11 is a simplified block diagram of a ORC predictive module for the control module of FIG. 10 under an illustrative embodiment.
Figure 12:
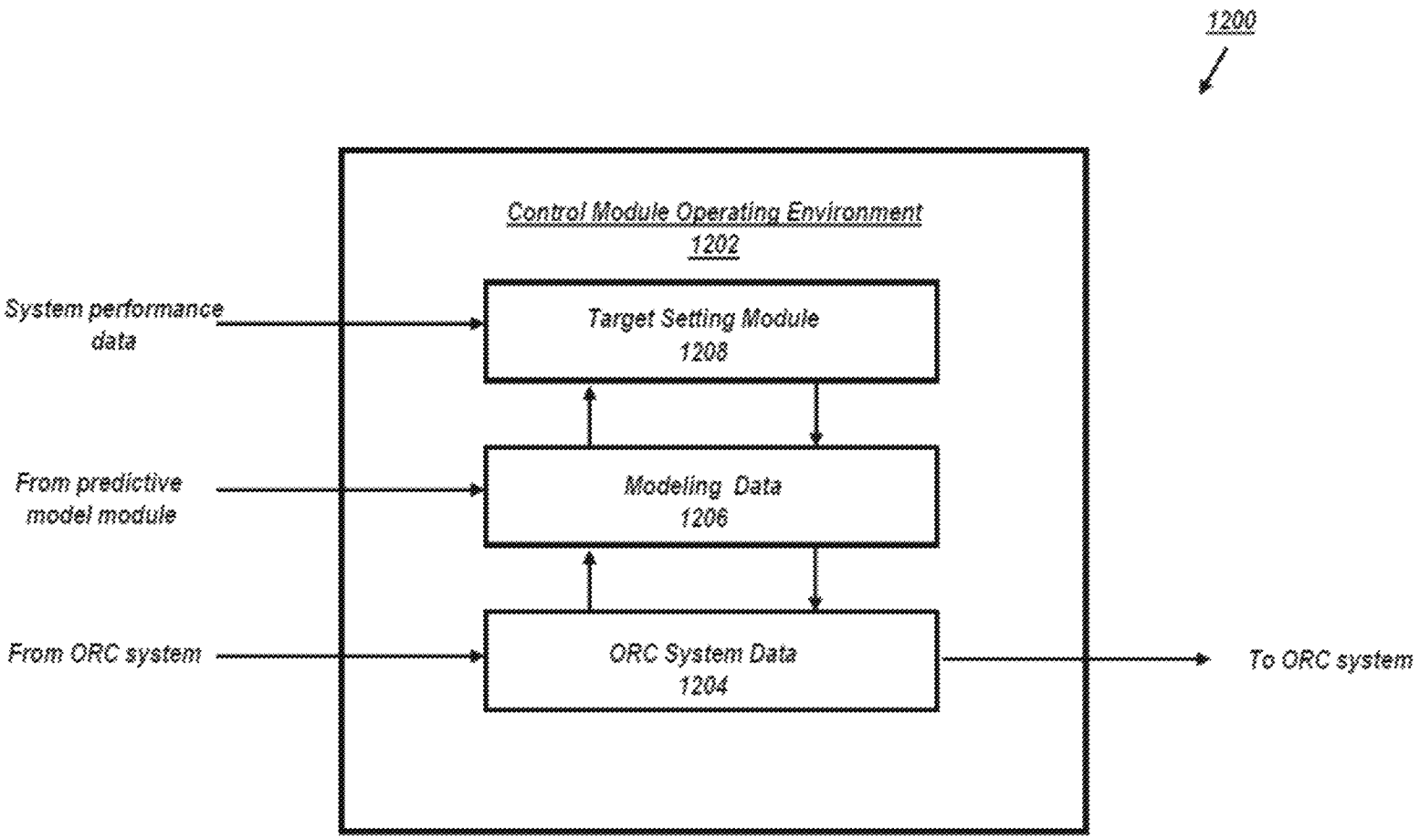
FIG. 12 shows an operating environment for the control module of FIG. 10 under an illustrative embodiment.

Flow of propellant through the Rankine cycle may be adjusted by a control module 100, which includes processor circuitry, such as that described in FIGS. 10-12 and may also include other components such as a variable frequency drive to vary the operation of the pump 50. Alternatively, the pump 50 may be a multi-stage centrifugal pump that is adjustable directly by the control module 100. That is, the control module (e.g., 100) will receive a signal from the monitoring module that the pump needs to speed up. In this example, the control module will then send a signal to the VFD that controls the electric motor at the multi-stage pump, thereby adjusting the flow rate of the propellant. Temperature and pressure of the propellant may therefore be monitored at one or more locations within the cycle to determine the required propellant flow for current operating conditions. A liquid level switch may be present on either the pre-heater 20 or on the evaporator 60, which will be monitored by the monitoring system. When the level is low, the control module (e.g., 100) will increase the flow rate to send more propellant to the heat exchangers.

As a further example, in cold weather conditions, propellant passing through an air-cooled condenser may require only minimal forced air flow across the condenser, as the surface area of the condenser fin tubes permits a significant degree of thermal energy transfer with the ambient air. Similarly, in cold weather, less thermal energy may be available for collection from the engine 10. Therefore, in cold temperatures, the control module (e.g., 100) may simply decrease the flow of propellant through the Rankine cycle by adjusting the speed of pump 50 to permit sufficient time to heat and cool propellant within the cycle.

The rotational speed of the expander is controlled by operation of throttle valves 31, 32 (opening and closing to adjust propellant flow through the expander), regulated by a speed control module, which is monitored by the monitoring system and control module 100. Cooling fans (if present) at the condenser may also be subject to the control module 100 such that fans are slowed, sped-up, or shut-down, depending on the outside ambient temperature relative to the amount of heat exchange being experienced between the propellant and the ambient air via the condensers heat exchange surface area.

Further, the control module 100 may include bypass valves 15 and/or 80 to divert engine thermal energy to/from the organic Rankine cycle system. Bypass valve 90 (if present), in combination with throttle valve 31 or 32, may divert heated fluids around the expander during start-up and shutdown of the Rankine cycle and/or engine. When de-activated, bypass 15 diverts engine exhaust gases to atmosphere rather than to the heat exchanger 13 and diverter valve(s) 80 diverts jacket water to the radiator 81. If required, thermal fluid circulating pump 51 and jacket water pump 52 may be sped-up or slowed-down by the control module 100 or shut down entirely. Similarly, with reference to FIG. 4, bypass 80 may be activated by the control module (not shown) to fully or partially divert jacket fluid to the engine radiator 81 (which is preferably inactive during operation of the Rankine cycle) rather than to the heat exchanger 20, and if required, jacket fluid booster pump 52 may be simultaneously adjusted to meet the required flow. Thus, organic propellant 86 passing through jacket heat exchanger 20 will not collect engine jacket heat as the jacket water in the heat exchanger will be stagnant. Similarly, the thermal fluid loop collecting engine exhaust 12 heat may be shut down by de-actuating valve 15 such that it diverts engine exhaust to atmosphere and if required, actuating valve 92 to dump thermal fluid from the thermal fluid loop to a storage tank and preventing operation of thermal fluid pump 51 so that propellant does not receive thermal energy from the thermal fluid loop. Therefore, propellant within the Rankine cycle will adapt quickly to the thermal energy added or removed from the system.

Bypass valve 90, if present, may also be activated in conjunction with throttle valve 31 during start-up and shut-down to direct propellant from the evaporator 60 directly to the recuperator, bypassing expander 30. Similarly, the recuperator may also be bypassed such that the propellant flows directly from the evaporator to the condenser. Bypass of the expander 30 prevents propellant from entering expander 30. This is desirable when the propellant is in liquid state, as entry of liquid propellant at high flow rates and pressures into the expander 30 may damage the internal components of the expander. Also, when the system shuts down and the propellant starts to cool, it contracts. Significant enough contraction could cause the expander to spin in reverse, potentially causing the generator to also operate in reverse. As an added measure, a check-valve or control module 100 may close the back-pressure throttle valve 31 to prevent this.

On system start-up, the expander may be bypassed by controlling valve 90 such that propellant is diverted to flow through bypass 91. It is generally desirable to maintain flow through the recuperator to speed heating of the organic propellant within the Rankine cycle system. In certain embodiments, such as use of a screw expander, such bypass may not be necessary, as a screw expander has robust internal components and can handle liquids flow at low pressure. In a start-up situation, propellant pump 50 may not be activated by the control module 100 to operate until the heat at the preheater 20 and the evaporator 60 are sufficient to boil any propellant that is in the evaporator at start-up. Either the pre-heater or the evaporator may have a level switch in it to send a signal to the monitoring module, which then sends a signal to the control module, which then controls the speed of the propellant pump. When the propellant level in the heat exchanger with the level indicator (pre-heater or evaporator) is high, the propellant pump slows down and when the level is low, the propellant pump 50 speeds up to send more propellant to the heat exchanger (pre-heater or evaporator). In a start-up situation, the level switch in the heat exchanger (pre-heater or evaporator) will read that the level is high and the pump will be inactive. Once the thermal energy from the engine heats up the propellant, the propellant will expand and flow towards the expander (because the propellant pump 50 is off and the throttle valve 31 will be open). Once the level in the level controlled heat exchanger (either the pre-heater or evaporator) gets low, the propellant pump will slowly start pumping fluid through the ORC such that the rate of boiling exceeds the rate of pumping, thereby insuring that any propellant entering the expander is in a gaseous or semi-gaseous state. Therefore, on start-up, the only liquid propellant that shall pass through the expander will be the propellant that was between the evaporator 60 and the expander 30, which condensed to liquid when the system was not operating. That fluid will be slowly moved through the expander in liquid state at a low pressure and low speed, thereby minimizing the liquid exposure to the expander. The control module 100 typically operates these systems to react to the conditions being generated in the ORC system.

EXAMPLES

A preferred system in accordance with the invention is intended for use with a reciprocating engine of the type commonly used to power electric generators or natural gas compressors, but is also useful with reciprocating engines that supply motive power to a vehicle, heavy equipment, or otherwise provide power to do useful work. Generally, the reciprocating engine is used to provide power in stationary applications for generating electricity and for compressing natural gas for pipeline transport, and the secondary power source is produced in the form of mechanical shaft horsepower by the expander. This mechanical shaft horsepower may be used to: 1) couple to a compressor to boost the inlet pressure of a primary compressor or to generically move gases (see FIG. 8); 2) couple to a pump to pump liquids (see FIG. 9); or 3) couple to an electric generator to produce electricity at grid-connected or remote sites where the electricity is then used to reverse feed the grid, supplement electrical demand on-site or power parasitic loads of the reciprocating engine or the ORC system or assist the compressor in compressing gas. More specifically, the mechanical shaft horsepower may be used to compress gas as a boost compressor for the primary compressor, to supplement the mechanical shaft horsepower of the primary reciprocating engine, to pump liquids, or to generate electricity for any other local energy need. Thermal energy may be collected from one or more such engines and processes, with the system collecting thermal energy from all sources to provide further efficiencies in the operation of the Rankine cycle to produce secondary power.

Suitable organic propellants for use within Rankine cycle systems are known in the art, and generally include branched, substituted, or aromatic hydrocarbons, and organic halides. Suitable propellants may include refrigerants, CFCs, propanes, butanes, pentanes, or other suitable propellants known in the art. Preferably, the propellant is butane, pentane, isobutane, R-134, or R-245fa.

Thermal energy is preferably collected from at least one of the engine jacket fluid 11 and from engine exhaust 12. In most reciprocating engines, jacket fluid typically circulates about the engine and is directed to a radiator 81, where this radiant heat is dissipated to atmosphere by blowing ambient air across the radiator using a fan 83. In such system, the jacket fluid is instead directed to heat exchanger 20 during organic Rankine cycle operation, where the jacket fluid is cooled by exchange of thermal energy with liquid organic propellant that is at a cooler temperature than the jacket fluid, thereby pre-heating the organic propellant before it reaches the evaporator 60. The rate of thermal energy exchange may be controlled to some extent by controlling the speed and pressure of the jacket fluid by controlling pump 52 using a variable frequency drive control device, and using diverter valve 80 to divert the jacket water to the radiator as necessary. For example, the pump may be operated at a higher speed in hot conditions to prevent overheating of the reciprocating engine, or operated by sending jacket water to both the radiator 81 and heat exchanger 20 simultaneously to meet the cooling requirements of the engine in extreme ambient heat, while in cool conditions, the pump may be operated at slower speeds. When the ORC system is operational, diverter valve 80 directs jacket fluid to the radiator 81 in conditions when thermal energy exchange with cooler organic propellant is not desirable, or is not effective to sufficiently cool the reciprocating engine 10.

The reciprocating engine exhaust loop carries thermal fluid 14 between the exhaust system and the evaporator 60. Use of thermal fluid in this loop is preferable due to its stability even in the presence of high temperatures and sparks that may be present within the engine exhaust system. That is, if thermal fluid were to leak into the exhaust piping, it would burn off within the exhaust stack. By contrast, a propellant leak within the exhaust piping may cause a fire or even an explosion. Suitable thermal fluids for use within the thermal fluid loop are typically mineral oils or synthetic oils (for higher temperature applications) or synthetic compounds developed for heat transfer conductivity. These oils are generally formulated from alkaline organic or inorganic compounds and are typically selected to meet the site conditions and thermal conductivity requirements of their operation.

The engine exhaust can be directed to the thermal fluid heater 13, or diverted past the thermal fluid heater (the organic Rankine cycle system) and vented to atmosphere. When the thermal energy from the engine exhaust 12 is required, diverter valve 15 will: 1) simultaneously start closing flow to atmosphere and start opening flow to the thermal oil heater 13 or 2) start opening flow to the thermal oil heater 13 and then start closing the flow to atmosphere, as regulated by the control module 100.

The thermal fluid cycle pump 51 driving the thermal fluid loop may also be controlled by the control module 100 using a variable frequency drive control device as needed. In situations when the organic Rankine cycle is inoperative due to shutdown or failure of the ORC or reciprocating engine, the exhaust diverter valve 15 will divert the hot engine exhaust 12 to atmosphere and the thermal oil circulating pump 51 may be turned down and valve 92 closed to divert thermal fluid into the storage tank 46. Another option is to shut down the entire thermal fluid system to avoid supplying any residual thermal energy already present in the thermal fluid to the evaporator 60.

Evaporator 60 is a heat exchanger through which energy from the engine exhaust heat 12, collected and transferred within the thermal fluid 14, is transferred to the preheated organic propellant 86. As engine exhaust 12 may reach temperatures in excess of 1200 degrees Fahrenheit, a steady supply of such thermal energy is readily available for use in evaporating the organic propellant. However, rather than passing preheated organic propellant about the engine exhaust system directly (which bears the risk of propellant leaking from the heat exchanger into the exhaust system and causing a fire or an explosion), the evaporator and thermal fluid loop are present to effectively reduce this risk through physical separation, while still supplying sufficient thermal energy to evaporate the organic propellant. Further, the thermal fluid thermal energy transfer loop permits thermal energy from the engine exhaust to travel a significant and safe distance (in insulated pipes) from the engine prior to being transferred to the organic propellant. Without this physical separation, either the evaporator and additional ORC components would need to be located immediately adjacent to the engine to prevent loss of exhaust heat (which is not practical or possible in many situations), or the propellant would lose energy as the distance between the evaporator and expander increased. Thus, in the system shown in FIG. 3, preheated organic propellant enters evaporator 60 in a saturated or liquid state, and collects sufficient thermal energy from the thermal fluid 14 loop to evaporate the propellant into a saturated or super-heated gaseous state, which exits evaporator 60 in a gaseous form. Hot thermal fluid 14 may be diverted to a storage tank 46 when the Rankine cycle is not operating.

The gaseous propellant is then used to produce mechanical energy as a secondary power source by expanding the gaseous propellant within expander 30. As it is desirable that the propellant should enter and exit the expander in gaseous form, appropriate sensors and controls are present at the expander 30 to allow the control module 100 to monitor and adjust the rate of thermal energy entering the ORC system, air flow across the condenser, propellant flow and back pressure by the throttle valve 31 (used to control the rotational speed of the expander so that the shaft speed can be used to generate electricity or match the rotational speed of the primary power source) through the expander. Information from these sensors may also be used in the control of propellant flow within the Rankine cycle by adjusting pump 50 or the back pressure throttle valve 31. If necessary, diverter valve 90 may be activated to direct propellant through bypass loop 91 when secondary power generation is not necessary, or to divert liquid propellant from entering the expander 30. In addition to diverting the propellant within the ORC, engine thermal energy may be diverted to atmosphere, by directing jacket fluid to the radiator 81, and by diverting engine exhaust to atmosphere.

In a preferred embodiment, the expander 30 is a screw expander. A screw expander typically has 75-85% efficiency, is easily controlled, is robust, and may be used with a variety of temperatures, pressures and flow rates. Moreover, although typical turbine blades may sustain damage upon contact with condensed/saturated droplets of propellant, the large diameter steel helical screws of a screw expander provide a robust mass and surface capable of withstanding temporary exposure to liquids. Therefore, use of a screw expander will improve the overall efficiency and integrity of the system. Throttle valves 31, 32, may be placed immediately before and/or after the screw expander to control the speed of the expander shaft, by controlling the propellant flow and pressure across the expander. When the throttle valve 31 is used alone to control the speed of the expander shaft by creating back pressure of propellant within the expander, the control module will regulate the propellant pump 50 by signals from the liquid level in the heat exchangers such that the pressure and flow of propellant entering the expander 30 may fluctuate due to the pump fluctuating and therefore the throttle valves 31 or 32 will have to adjust the speed of the expander shaft to support the degree of back pressure applied by the throttle so as to maintain a suitable/preferred pressure differential.

A recuperator 70, as shown in FIG. 3, is preferably included to reabsorb much of the thermal energy that is not dissipated at the expander before it reaches the condenser, thereby improving efficiency of the system and increasing secondary power generation. Cooled propellant from the condenser is passed through the opposing side of the recuperator 70 to add thermal energy to this propellant that is en route to the pre-heater 20. In some examples, the system disclosed herein may provide evaporation using either or both of engine exhaust energy and/or jacket water in the heat exchanger.

System Control

The control module 100 for use in an illustrative embodiment includes a monitoring module that monitors multiple settings and conditions of the system, such as but are not limited to the temperature, pressure, speed, flow, valve position, relay/switch position or electrical load of parasitic elements of the inlet and/or outlet of: ambient air, and/or the propellant (via the expander, recuperator, condenser, pump, evaporator, or superheater), and/or thermal fluid, and/or jacket water system, all while adjusting the parasitic loads of the system as needed to improve efficiency and maximize secondary power generation. Suitably, various sensing devices such as but not limited to temperature sensing devices, pressure sensing devices are placed at the expander and/or condenser to enable monitoring of the physical state of the propellant at these locations. Preferably, such devices are placed at each of the expander 30 and condenser 40 to enable monitoring of the physical state of the propellant at both locations. The control module may adjust: the propellant pump 50 speed, fan speed at the condenser if air-cooled, pump speed if liquid-cooled, diverter valve 15 at the exhaust bypass, speed of pump 51 of the thermal fluid pump, diverter valve 80 at the jacket water bypass, or speed of pump 52 of the jacket fluid pump to ensure that propellant entering the expander is gaseous, and propellant exiting the condenser is liquid.

The control module 100 may be manual, but is preferably automated, including a processor for collecting and processing information sensed by the monitoring module, and for generating output signals to adjust flow of heat sources (to or away from the ORC system) and adjust propellant through the system, activate valves, and adjust pump and fan speeds as necessary. These adjustments may be made through use of programmable relays or through use of variable frequency drives associated with each component. The processor may further collect information regarding primary and secondary power output and may activate a tertiary power source when more power is required.

Notably, the amount of thermal energy collected from the engine 10 body may be adjusted by the control module by varying the flow of fluid through the engine jacket heat exchanger by diverting it to or from the radiator 81. Similarly, the amount of thermal energy collected from the exhaust system 12 can be varied by regulating the exhaust diverter valve 15, such that the exhaust energy can be diverted to atmosphere or to the thermal fluid 14 through heat exchanger 13. Further, the amount of thermal energy transferred from the thermal fluid 14 to the organic propellant 86 may be varied by adjusting the flow rate of thermal fluid through the thermal fluid system by circulating pump 51, or by temporarily diverting thermal fluid to a holding tank 46. This is particularly useful during start-up and shutdown of the system as the system may be heated and cooled quickly in a systematic manner. Using a screw expander to create mechanical shaft horsepower within the Rankine cycle further improves the robust nature of the system, which is particularly beneficial during start-up and shutdown. Specifically, as the screw expander will tolerate temporary passage of liquid propellant, system start-up and shutdown are greatly simplified. On start-up, the control module 100 is programmed to add engine thermal energy to the system without circulating propellant 86 until the liquid propellant 86 in the engine-associated heat exchangers reaches its operating temperature. At this point, the circulating pump 50 is started at slow speed to ensure that propellant 86 is sufficiently heated within the engine-associated heat exchangers 20 and 60 to evaporate the propellant prior to reaching the expander. In this manner, only a minimum amount of liquid propellant (in the piping between the evaporator 60 and the expander 30) will pass through the expander 30 on start-up, eliminating the need for bypassing the expander on start-up. Thus, the Rankine cycle is quickly operational upon pump 50 start-up and thermal energy may be collected and used for secondary power generation in accordance with the invention.

Figure 4:
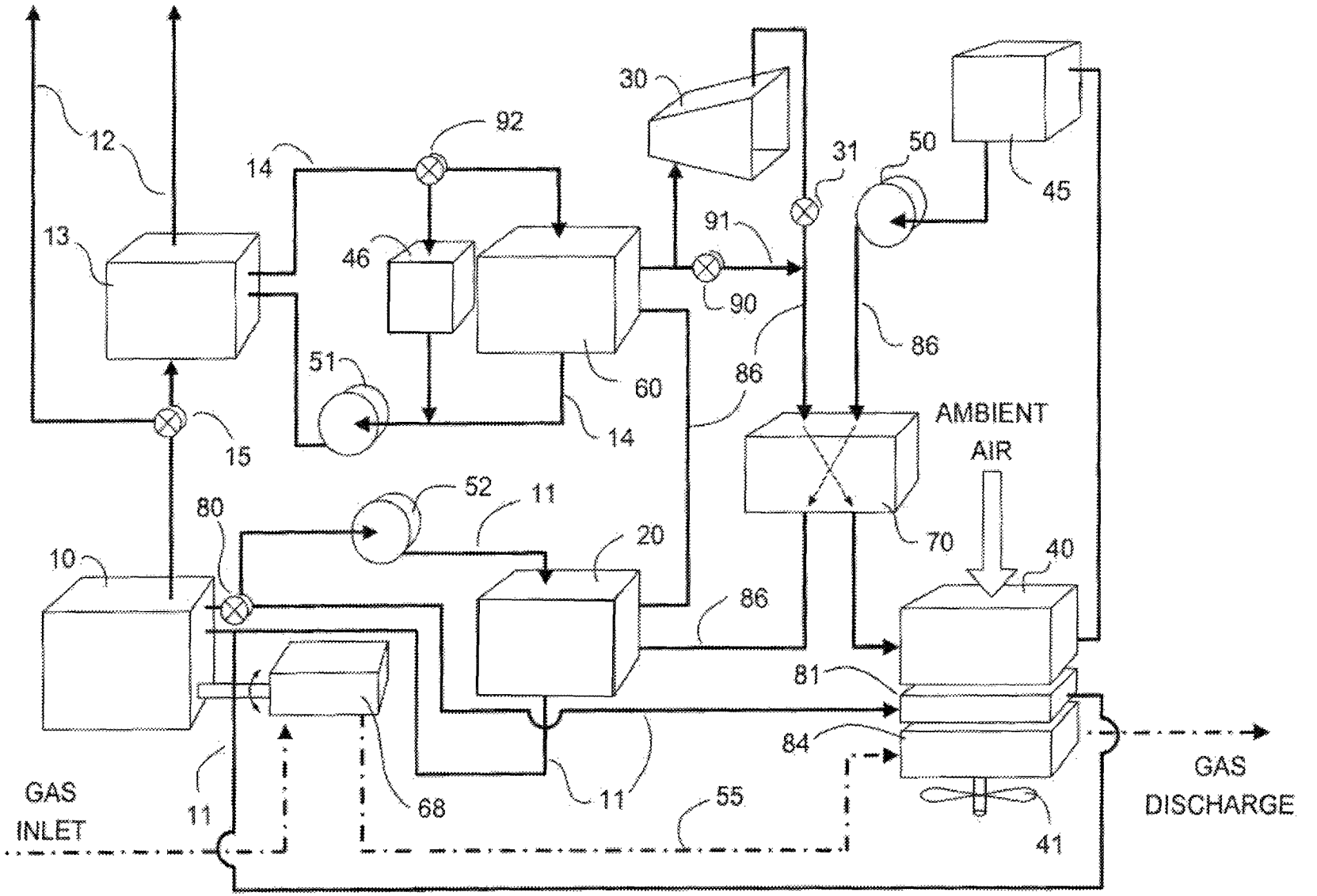
FIG. 4 is yet another simplified thermal energy recovery system under an illustrative embodiment.
Figure 5:
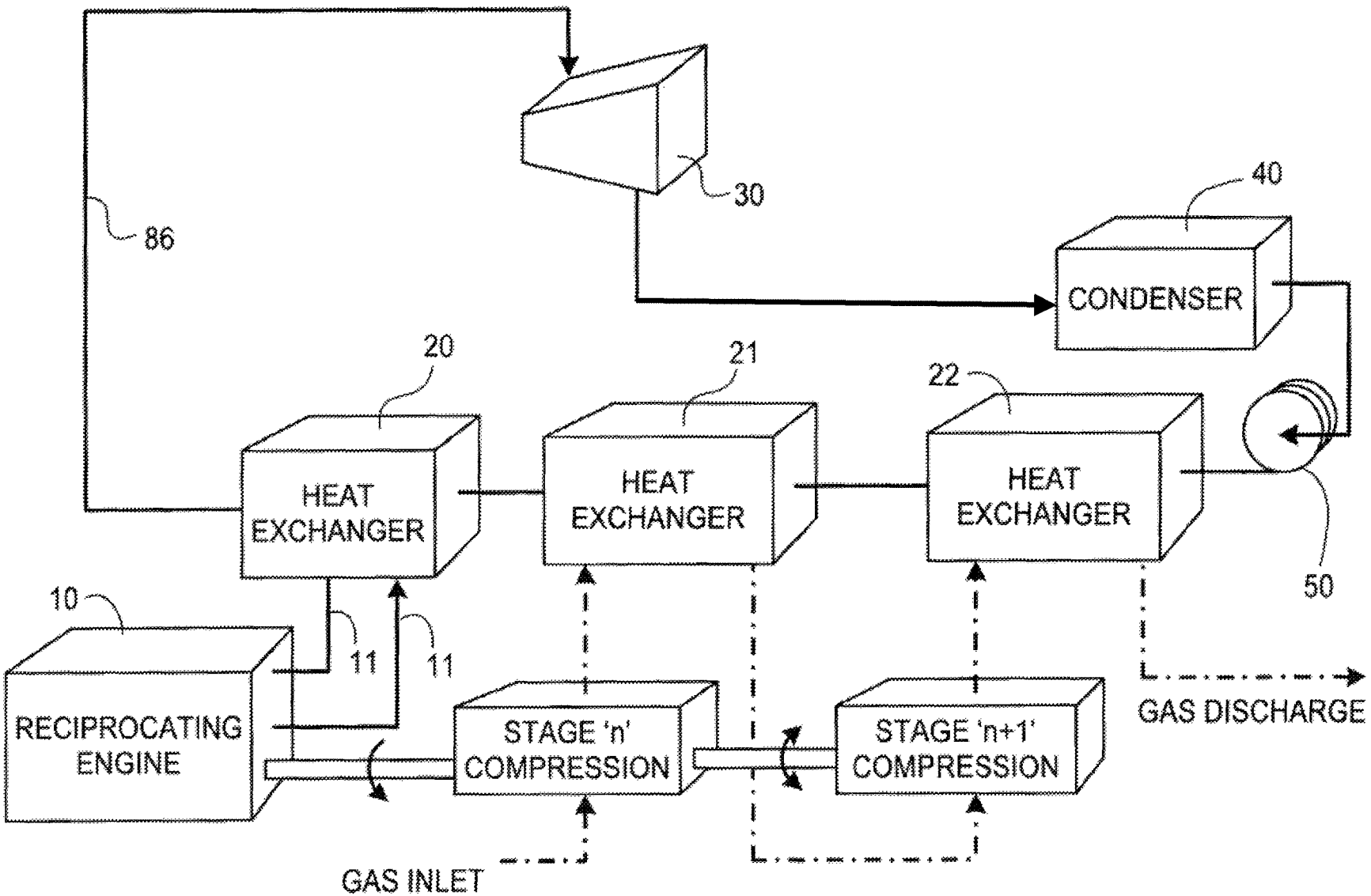
FIG. 5 is yet another simplified thermal energy recovery system under an illustrative embodiment.
Figure 6:
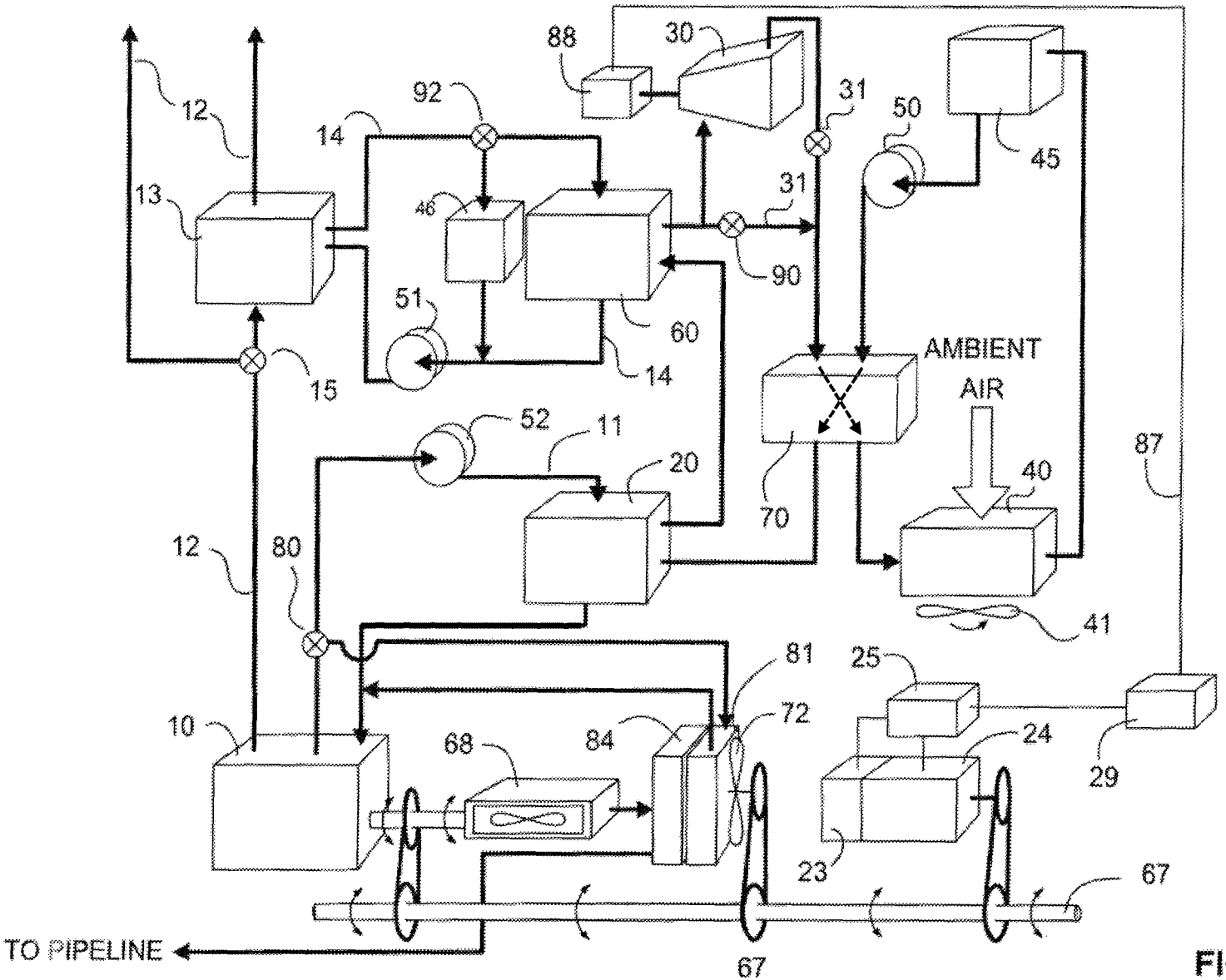
FIG. 6 is yet another simplified thermal energy recovery system under an illustrative embodiment.

With reference to FIGS. 4 through 9, the engine may be used to power natural gas compression. In these embodiments, further thermal energy may be recovered from one or more of the gas compression stages, as each stage of gas compression generates a significant amount of thermal energy that must be removed from the gas before the gas enters the pipeline system. Typically, the engine jacket water is cooled in an air cooled radiator 81 and the natural gas is air-cooled after each stage of compression in gas coolers 84. As shown in FIG. 6, the gas coolers 84, when co-located together with the radiator 81, are referred to as an "aerial cooler" (an air-cooled fin-tube configuration including a common fan 72 that blows air across both sets of the fin-tubes), and engine exhaust is vented to atmosphere. Instead of simply dissipating this heat to atmosphere, the thermal energy generated from the exhaust, the jacket water, and each stage of gas compression may be collected within heat exchangers 13, 20, 21, and 22 and used to heat organic propellant between the condenser and the expander, as shown specifically in FIGS. 5, 6 and 7. This recovered thermal energy will result in additional secondary power generation, which power may be used to further improve system efficiency. Moreover, as shown in FIG. 4, the gas cooler 84 may be co-located with air-cooled condenser 40 and with radiator 81 to permit cooling by one set of fans 41 operated by the control module 100.

Figure 7:
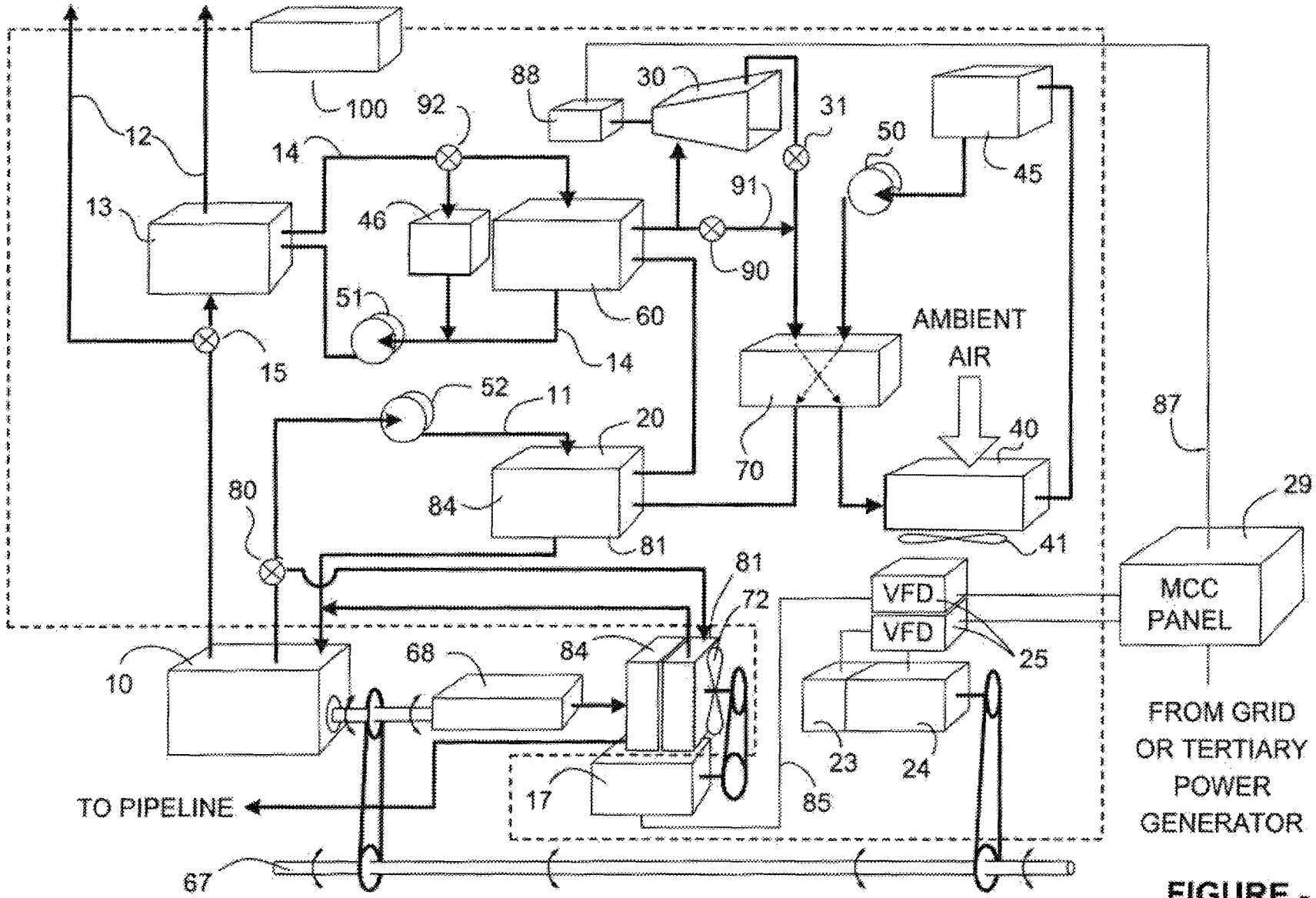
FIG. 7 is yet another simplified thermal energy recovery system under an illustrative embodiment.
Figure 8:
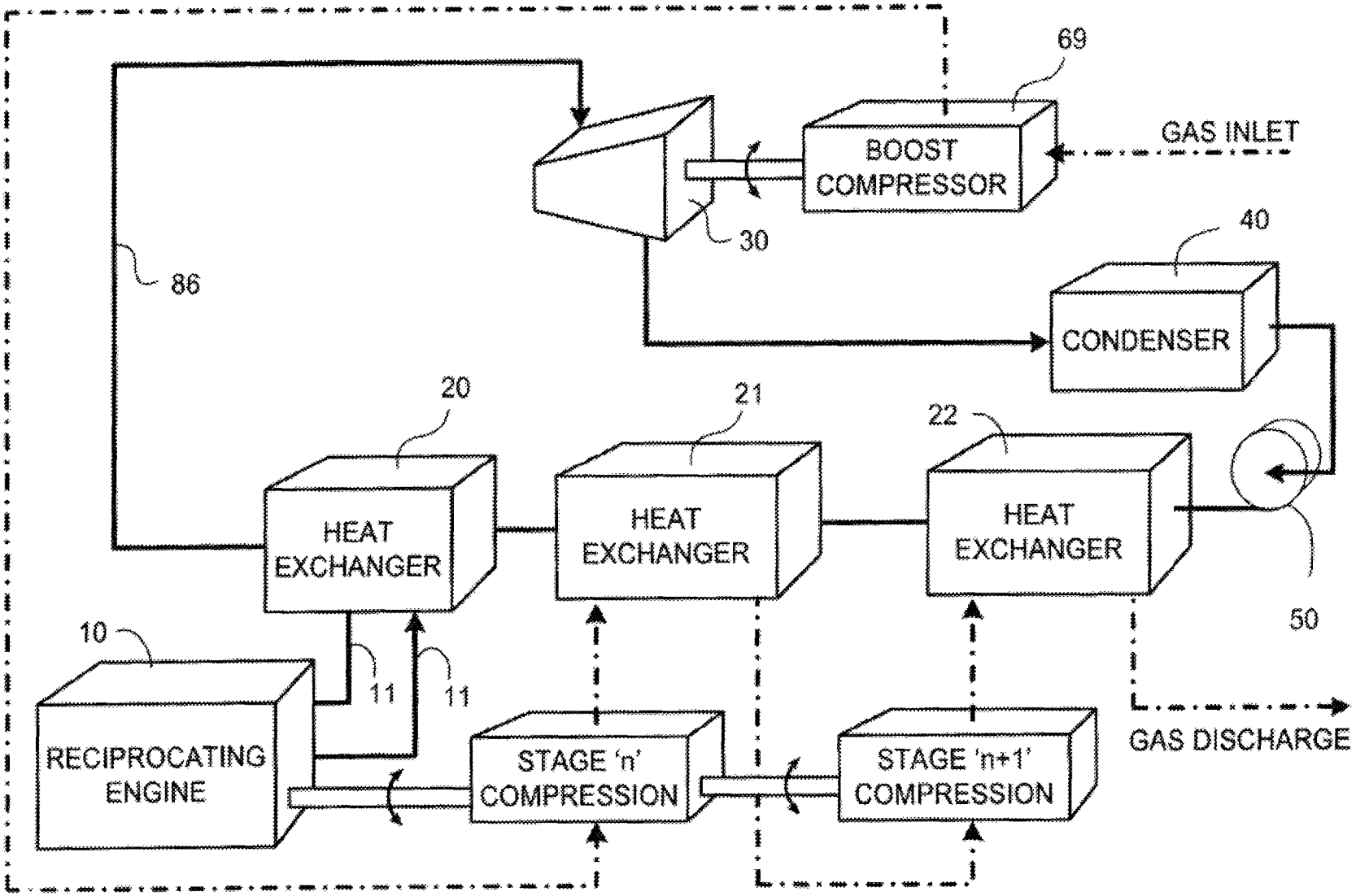
FIG. 8 is yet another simplified thermal energy recovery system under an illustrative embodiment.

As cooling fans 41 and 72 are a major parasitic load within the system, the control module is programmed to reduce fan speed whenever possible, for example in cool weather. This is accomplished by providing an electric fan with a variable frequency drive, or by providing a multi-speed fan operated directly by the control module. In typical gas compression configurations, the associated aerial cooler fan 72 is often powered through a jack-shaft coupled to the primary engine's crank shaft via a series of shafts and pullies (as shown in FIG. 6), drawing horsepower directly from the primary engine. Similarly, a reciprocating engine coupled to a generator is typically associated with a belt-driven radiator fan 83 (as shown in FIG. 3). As depicted in FIG. 7, an opportunity exists to de-couple the fan 72 from the jack-shaft 67 and drive fan 72 directly with an electric motor 17, that is controlled by the control module 100, by feedback from the monitoring module which utilizes a VFD 25 (or as a controllable multi-speed fan) to control its speed. The power load of fan 72 is now being supplied by the secondary power source, thereby reducing the load on the primary engine. The reciprocating engine may therefore use less fuel to produce the same amount of net horsepower, or conversely, may consume the same amount of fuel with more primary power output. This configuration could obviously use multiple fans 41, 72 in place of a single fan 41, 72.

Any power generated that is not consumed in motor 17 to drive the fans 72 can be transferred to the jack-shaft 67 via electric motor 24 which has a speed sensor 23 to match the rotational speed of jack-shaft 67 so that the surplus power available can be utilized to assist the primary engine in driving the compressor (or whatever the primary reciprocating engine may be doing—generating power, etc.). As explained above, the result is that the reciprocating engine 10 will consume less fuel to compress the same amount of natural gas or the reciprocating engine will now have additional horsepower capacity to drive compressor 68 so that it can compress more gas on the same amount of fuel that was previously consumed.

With specific reference to FIG. 6, a suitable configuration is shown in which the aerial cooler/radiator fan 72 is mechanically connected to the jack-shaft 67 of the reciprocating engine 10, which is further connected to an additional electric motor 24. Motor 24 is equipped with an encoder 23 which monitors the speed of the jack-shaft 67, and then communicates with variable frequency drive 25 to apply the right amount of torque at the matching speed to supplement the mechanical shaft horsepower and speed of the jack-shaft 67, or the reciprocating engine 10 as necessary.

The electric motor 24 may be supplied with secondary power from the Organic Rankine Cycle, or by an independent, tertiary, power source. Thus, once the ORC system is established, parasitic loads on the engine (such as the fans used in gas compression cooling and radiator cooling) may be balanced directly with supplemental torque from the electric motor 24, either through use of secondary or tertiary power. This will reduce: engine load (which reduces fuel consumption), grid-based power usage, and engine maintenance while maintaining a constant level of total power output and rate of natural gas compression. The control module 100, through the monitoring module, may be configured to determine the optimal configuration based on not just net output of the ORC but also on the price of natural gas versus the price of power to decide how much of the secondary power should be put into moving more gas versus generating secondary power. Which by nature will determine if site power is the best use of the power or exporting to the grid is the best economic outcome.

Conversely, if the engine load is maintained, (which maintains fuel consumption), then the engine maintenance will also be maintained while the total power output from the primary engine 10 is increased and rate of natural gas compression is thereby increased. The control module 100, through the monitoring module, monitors the jack-shaft 67 speed via encoder 23 and regulates the amount of torque provided by the electric motor 24 to achieve these endpoints. Any secondary power not required by the electric motor may be diverted elsewhere on site or to the grid, if applicable.

Computer modelling suggests that fuel consumption of the gas compressor may be reduced by approximately 4% to 8% by simply converting the propulsion of the aerial cooler fan 72 to be propelled by an electric motor 17 monitored by the monitoring module and controlled by the control module 100 to provide adequate cooling. Accordingly, this reduces the load on the engine by approximately 4% to 8%, thereby providing capacity for the primary engine to produce 4% to 8% more horsepower with the same amount of fuel, or to reduce fuel consumption by 4% to 8%. In addition, if more horsepower is produced by the secondary source than is required to run the system parasitic loads, for example the aerial cooler fan(s) 72 or cooler fan(s) 41, the supplemental mechanical shaft horsepower may be used to assist the reciprocating engine in driving the compressor 68, or to supplement further crank-shaft dependent or parasitic loads within the system. The controller 1000 could determine if the best economics are to use the shaft horsepower generated by the orc for use as a boost compressor, pump or electric generator and whether that power would be used to offset parasitic loads or for other uses on site. In terms of system economics, predictive modeling may be based on a plurality of evaluative platforms and/or stages. In some examples, a first stage of economic benefit is directed to the design stage, where the sizing of the various components takes place, and the cost of assembling those components into a system, all require careful consideration of the long-term economic return of the equipment. Another stage may be directed to the operation of the system. A control module (e.g., 1000, 1100, 1200 or 1400) as disclosed herein may be configured to run appropriate algorithms to maximize net power output with the parameters of the conditions set by the design stage. In other words, the control module may be configured to make the best of the physical limitations of the duties within the components and calculate how it can optimize the net power out of the overall system. In some examples, there may be configurations for moving the energy to the TEG that will maximize the output of the TEG. However, that configuration could hamper the operation of the engine and the ORC. Therefore, the overall control module must take into consideration meeting the engines reject heat requirement such that it does not over cool nor under cool the jacket water on return to the engine, that the delta T across the TEG and the heat transfer between the ORC and TEG is determined in order to optimize the net power of the system output and the engines operability. Meaning, the control module would actively work to optimize the net power output of the system, which includes the combination of the engine, the ORC and the TEG, by controlling the various control elements within the system, in order to optimize the net power (meaning gross power generated minus the parasitic loads within the system) of the entire system. The current configurations would typically work as independent systems which may not result in an overall optimized net system efficiency because the units all use the same energy source(s), they could end up competing with one another for that energy, at the sacrifice of maximizing the overall system efficiency.

Ultimately, the control module 100 in conjunction with the monitoring module, controls recovery of thermal energy from the primary power engine 10 and uses this thermal energy to create a secondary power source. The control module is programmed to maximize net horsepower. For example, in some circumstances, more net horsepower may be produced by reducing parasitic loads within the system, while in other circumstances more net horsepower may be produced by maintaining or increasing parasitic loads and driving secondary power generation. The monitoring module and control module therefore work together to reallocate thermal energy from the jacket water and the engine exhaust, determining the optimal parasitic loads on the ORC system in order to further maximize secondary power generation as necessary. In all embodiments, the reciprocating engine 10 operates at a given capacity, and the inherent operational requirement for removal of engine thermal energy is achieved by some combination of: diversion of exhaust gases to atmosphere; cooling of the engine by its radiator fluid loop; collection of exhaust heat for use within the ORC system; and collection of engine jacket radiant heat for use in the ORC system.

The reciprocating engine may be used to drive an electric generator in remote locations where or when grid power is not available, or where use of grid power is undesirable. The secondary electric power or mechanical shaft horsepower generated by the ORC system may be used to: supplement the primary power created by the reciprocating engine; supplement the parasitic loads of the ORC system; or to offset usage of tertiary power. The control module 1000 would actively calculate the best economic value/return on that use of power. Where previously control module 100 has been referenced, use of the numbering system to reflect control modules for 1000, 1100, 1200 and 1416 can be deemed interchangeable.

The control module is programmed based on tabular data that has been compiled by running simulation software designed to optimize power output. That is, various possible readings from the associated monitoring module (for example ambient air temperature or temperature/pressure of propellant) are initially compared to the optimized tabular results and corresponding adjustments are made to the ORC system to see if these alternations improve the net horsepower output of the system. The complete data set of such readings and corresponding optimized operating conditions are loaded into the control module to enable the system to quickly settle into optimal operating condition in any situation. As the system gathers operating data and the system performance is compared to that of the simulated operation, adjustments to the programming of the control system may be made to get the best results through the iterations previously encountered. In some examples, simulation software may be configured to run iterative calculations (e.g., thousands to millions of iterations) to settle in on a most probable solution. The result of the simulation software is but one final solution based on statistical probabilities of being the most likely. However, with every change of a condition, the simulation may not account for these dynamic changes and the application of an intelligent system would be most beneficial for optimizing efficiency and performance, which results in optimizing the economic outcome of the system.

When the system is generating secondary power as electricity, for example, the secondary power generated is sent to a motor control center or power hub 29 (as shown in FIG. 6 and FIG. 7), which also receives power from any other sources (the reciprocating engine coupled to a generator, grid, tertiary source, etc.) and allocates power on demand. When the parasitic loads of the ORC system and other site power loads is not satisfied by the primary and secondary power sources alone, the motor control center 29 may indicate to the demand module, which then corresponds with the control module 100, that the tertiary power to the site should be dispatched to start generating power.

In a specific example, the reciprocating engine may be used to compress natural gas, with secondary shaft HP used to: 1) power a boost compressor that boosts the inlet gas pressure of the primary compressor 68, 2) power a pump that can be used to re-inject produced water, 3) power a generator, or 4) supplement the output of the primary source or its parasitic loads. The control module 1000 may be configured to actively calculate the best economic value/return on that use of shaft horsepower.

In certain situations, particularly in remote locations, a demand for power exists in operation of a work site. Notably, the demand may fluctuate from time to time. As such, a tertiary power source may also be available, such as a generator, solar power, wind, fuel cell, or grid power. This tertiary source of power may be operated as the main source of power on the site with the reciprocating engine and the secondary power utilized as additional power to supplement the sites power requirements for what is not being met by the tertiary source. In some other cases, the power generated by the engine and secondary power source may be the main power source for the site and combined they may not be sufficient to meet the needs of the job site and therefore an additional fuel based or grid tertiary power source may be required to be dispatched so that the site demand can be met.

Accordingly, the control module 100 may also initiate alterations in performance which may require tertiary power. However, in certain embodiments, tertiary power should only be accessed when necessary to ensure an uninterrupted supply of power to the site. Usage of the tertiary power source will increase the operating cost of the site, however: 1) the overall cost of power will be reduced as power may be supplied by the thermal energy recovery system in place of fuel-fired generators; and 2) in many off-grid locations the total operating cost is less important than providing a reliable level of power at the site.

The above-described systems are particularly advantageous in that they are operable at low temperatures and pressures, allowing the use of relatively inexpensive components. Standard pressure configurations for valves, pipes, fittings, etc. are 150 psi, 300 psi, 600 psi, and 900 psi. With certain seal designs, the system may be capable of operating virtually at any pressure because the seals are non-contacting and the pressure they would normally contain is now contained by the gear box housings and not the seals. The resulting only two points the system has to leak to atmosphere is the circulating pumps seals and the expander output shaft seal. Because the propellant circulating pump is pumping a liquid it is much simpler to seal when compared to trying to seal a gas. Regarding the expander output shaft, it can make use of a multi-stage seal where the interstitial levels of pressure are staged down to bridge the pressure differential between the output gear box and atmosphere. This configuration will allow the system to operate at high pressures required for super critical pressure ORC system operation. This leads to maximize versatility of the system, and to minimize costs.

Notably, a screw expander is well suited to operate on reduced pressure differential with an increased flow rate. Computer modelling demonstrates that this reduced pressure differential only trivially reduces net horsepower output (due to the slight increase in pump parasitic load necessary to move more propellant), because screw expanders use a rotary type positive displacement mechanism rather than turbo-expanders, which are centrifugal or axial flow turbines. Specifically, the top-end pressure is lower and therefore less horsepower is required to drive the propellant to maximum pressure, however slightly more horsepower is required to move the increased fluid volume. By reducing the operating pressures and temperatures, computer modelling demonstrates that a wide variety of organic fluids are suitable for use within the present system, some of which would otherwise not be as feasible with turbo-expander based ORC systems. The control module 1000 would actively calculate the best economic value/return on that use of shaft horsepower.

Control Example

With respect to specific control of the ORC system, when the heat sources are constant, one of the primary drivers of variable output is ambient air temperature variations, for ORC systems that use air cooled condensing. Not only does ambient air temperature vary over the annual seasons, it varies throughout each day. Based on the information gathered by the monitoring module, such as ambient air temperature, and knowing the surface area of the air-cooled condenser 40 fin-tubes as well as the amount of air that can be moved across the fin-tubes by the fan system 41, the degree of propellant 86 condensing can be calculated by the control module 100, using standard calculations. For the current system pressure (which is based on the temperature of the propellant), as the limit of propellant cooling is determined by the ambient air temperature, surface area of cooling fins, flow of ambient air movement, and propellant pressure, and how these factors relate to the propellant flow rate, temperature and pressure at which the propellant enters the condenser, the degree of propellant cooling/condensation may be adjusted by adjusting the speed of the propellant pump 50, adjusting the amount of energy taken from the various heat sources (where an increase (decrease) in jacket water would increase (decrease) the flow rate through the ORC system, and an increase (decrease) of thermal oil flow rate or temperature would increase (decrease) the system pressure), adjusting the pressure across the expander 30 via a combination of throttle valves 31 or 32 and the propellant pump pressure, or a combination of adjusting both propellant pump speed 50 and the pressure across the expander 30. Because there are so many variable to adjust, including parasitic loads, which all will affect the net output, the intelligent system disclosed herein may probe the various variables beyond the theoretical calculations to optimize and increase the net output (efficiency) of the ORC system.

Alternatively, the thermal energy input may be adjusted by controlling the rate of: 1) exhaust flow 12 to the thermal fluid heater 13, which then transfers thermal energy to the thermal fluid 14 within the thermal fluid loop and/or 2) the jacket fluid 11 loop. The control module 100, in conjunction with the monitoring module, therefore determines all possible schemes by which the degree of propellant cooling may be adjusted and calculates the anticipated parasitic loads and hence net power output. The system implements the scheme and maximizes net power output by making the appropriate system adjustments.

Alternatively, the system may be programmed to automatically implement various schemes when certain combinations of monitored parameters are identified and the system reacts to the conditions. For example, the ORC system may be allowed to operate, with the control module reacting to ensure that the propellant leaving the condenser is liquid and the propellant entering and exiting the expander is gas. As the system may be constrained by the ability to condense propellant (whether air cooled condensing or cooling water), the monitoring and control module logic would maximize condensing medium and if unable to maintain propellant condensation, the input thermal energy from the engine will be curtailed by dumping the excess heat to atmosphere or increasing system pressure in the condensers. But because the system pressure in the condensers would reduce the pressure delta across the expander, the system pressure in front of the expander would also have to increase to maintain a consistent delta-P. This can be achieved by increasing the temperature of the propellant in this section of the ORC. This temperature increase can be achieved by altering the system flow rate. For example, the rate of evaporation can be reduced (by reducing the amount of energy collected from the jacket water) which will reduce the propellant flow rate. When maintaining the thermal oil temperature and flow rate from the higher propellant flow rate, the temperature of the propellant will be higher which will result in higher pressure.

It is recognized that in the above example, propellant condensation ability will be one of the primary drivers in determining the limiting factor in taking on additional thermal energy inputs. As thermal energy input to the system is increased, the condenser fan speed will continually be increased until it is at its maximum air flow. If this maximum flow cannot condense all of the propellant being pushed through the condenser, the control module will either divert some engine heat to atmosphere, or reduce the flow of propellant in the ORC system. If this adjustment is not sufficient (for example, when ambient temperatures are high), then engine exhaust may also be diverted by the control module to avoid thermal energy collection from this source. Simply increasing air flow across the condensers is one possible solution to the challenge. Because of the number of variables and levers the control module 100 can vary, a smart intelligent control system 1000 will be able to optimize the net power output from the ORC system better than a reactive control module 100.

Further, if removing the engine exhaust thermal energy is not sufficient to condense the propellant exiting the air cooled condenser, then the flow of jacket water to the pre-heater will also have to get curtailed by the control module 100, until the ORC system is able to condense all propellant.

Similarly, the system is also driven by temperature and/or pressure measurements by the monitoring module at the expander 30 to ensure propellant 86 entering the expander is in gaseous state. When more thermal energy is required to evaporate the propellant 86, the propellant pump 50 speed may be altered to allow more thermal energy transfer from the engine jacket 11 and exhaust 12 to the propellant. Similarly, the speed of the thermal fluid loop and jacket fluid loops may be controlled to increase or decrease the flow rates or the temperatures of those heat sources, which will supply more or less thermal energy to the heat exchangers 20, 13 and 60.

As a further example, in very hot ambient temperatures, the air-cooled condensers 40 may be running maximally to cool the propellant, which may still be insufficient for condensation of propellant. To address this, one of two solutions exist. The first would be to increase the system pressure to facilitate the condensing of the propellant, or the second would be to divert away thermal energy entering the system via the jacket water or engine exhaust which would then reduce the propellant flow rate through the system, which would then match up to the condensers duty capacity. For example, when increasing the ORC system propellant temperature (and hence the system pressure) condensation would occur at a higher temperature thus increasing the delta-T between ambient air temperature on one side of the condenser tubes and the propellant temperature. The other example would be to reduce propellant flow rate by diverting engine exhaust 12 to atmosphere, reducing the flow of thermal fluid 14, altering the pressure differential across the expander by use of the throttle valve 31, and/or jacket fluid 11 to the heat exchangers.

Turning now to FIG. 10, a control module 1000 is shown under an illustrative embodiment. The control module 1000 may be configured as control module 100 described above, or may be configured as an additional control module. Control module 1000 comprises a microcontroller 1002 that may be configured with one or more CPUs (processor cores) along with memory and programmable input/output peripherals. Program memory in the form of ferroelectric RAM, NOR flash or OTP ROM may also be included on chip, as well as a small amount of RAM. In some illustrative embodiments, the microcontroller is configured for embedded applications, and may also be configured on a system on a chip (SoC) platform.

Microcontroller 1002 includes a plurality of general-purpose input/output pins (GPIO) that are software configurable to either an input or an output state. When configured as an input state, GPIO pins may read sensors or external signals. Configured to the output state, GPIO pins can drive external devices such as relays, valves or motors, often indirectly, through external power electronics. Microcontroller 1002 may receive data from sensors 1004 that may include environmental sensors 1014 (e.g., temperature, pressure, etc.) radio frequency identification (RFID) and/or near-field communication (NFC) sensors 1016, as well as smart sensors 1018. The data from sensors 1004 may be received via communications 1012 that may include long-range wireless module 1040 (e.g., CDMA, LTE, 5G, etc.), short range wireless module 1042 (e.g., WiFi, IEEE 802.16.4, Zigbee, Bluetooth, RFID/NFC) or wired communication module 1044.

Microcontroller 1002 may further be coupled to a power module 1008 that includes power management module 1024, battery management module 1026, DC/DC converter 1028 and power regulators 1030. Data converter module 1006 may also be coupled to microcontroller 1002 and may include an analog-to-digital converter 1020 and an analog front end 1022. Analog signals, such as environmental signals, can be fed to A/D converter 1020, which may be configured to measure analog signals and converts the magnitudes to binary numbers. While microcontroller 1002 may be equipped with its own A/D converter, some high speed and/or high precision applications may require a more sophisticated A/D converter such as 1020. Analog Front End 1022 may be used for more complex waveforms, particularly when an A/D converter alone is not sufficient. The analog front end 1022 may be configured with a higher level of integration and include an A/D converter as well as signal conditioning blocks that can include a programmable gain amplifier (PGA) and filtering circuits. In such a configuration, the analog front end 1022 may advantageously perform the work of an A/D converter and several op amps. In some illustrative embodiments, the A/D converter 1020 may also include a digital-to-analog (D/A) converter to allow the microcontroller to output analog signals or voltage levels. Such a configuration may be advantageous when the controller is required to send digital and analog control signals to control valves, fans, and the like.

Microcontroller 1002 may further be coupled to data storage 1010 that may include cloud storage 1032, RAM memory 1034, flash memory 1036 and/or dedicated memory modules 1038 that may be used as removable memory for expansion, security, or program memory storage. While not explicitly illustrated in the figure, control module 1000 may be configured with a variety of timers, such as a programmable interval timer (PIT). The PIT may either count down from some value to zero, or up to the capacity of the count register, overflowing to zero. Once it reaches zero, the PIT sends an interrupt to the processor indicating that it has finished counting. This is useful for thermal applications that periodically test the temperature around them to see if they need to turn control an aspect of the thermal recovery system. Additionally, a dedicated pulse-width modulation (PWM) module may be used to make it possible for the microcontroller to control power converters, resistive loads, motors, etc., without using significant CPU resources in tight timer loops. Moreover, a universal asynchronous receiver/transmitter (UART) may be used to make it possible to receive and transmit data over a serial line with very little load on the CPU. Dedicated on-chip hardware may also be used to allow microcontroller 1002 to communicate with other devices (chips) in digital formats such as Inter-Integrated Circuit ($I^2C$), Serial Peripheral Interface (SPI), Universal Serial Bus (USB), and Ethernet.

Turning to FIG. 11, the figure shows an operating environment 1100 for an ORC system predictive module 1102, which may be configured within the control module 1000. ORC system predictive module 1102 comprises a predictive model module 1104, which may be configured to load a simulation program to generate one or more solutions for the predictive model into the control module (e.g., 1000) to predict thermal recovery system performance. Predictive models may be stored in data storage 1010, or any other suitable storage means. During operation, ORC system predictive module 1102 may be configured to receive sensor data as shown in the figure and filter, normalize and otherwise process the sensor data. Iterative simulations can be run based on the operating conditions to predict the theoretical solution, although that solution may not be the optimal, nor representative of what the actual equipment can generate. Under an illustrative embodiment, a predetermined (or "default") predictive model module 1104 may be loaded into the predictive model module 1102. In one example, an artificial neural network (ANN) may be loaded into the predictive thermodynamic model module 1102 and be used to predict system performance based on parameters such as ambient air temperature, work sensed from the pump(s), condenser fan operational speeds or electric motor load, heat transfer rates in the evaporator(s), work produced in the expander, heat transfer rate in the condenser, system pressure(s) in the various segments of the ORC, thermal efficiency of the ORC, enthalpy and/or mass flow rate of the working fluid, etc.

The ORC system predictive model may further include a classifier module 1106, that may include one or more classification algorithms configured to perform pattern recognition from the received sensor data and supervised by predictive model module 1104. Utilizing supervised learning, the classifier module assists in finding a function in the allowed class of functions that matches the sensed data. In other words, the classifier assists in finding the mapping implied by the data. A cost function of the ORC system may be configured as the mismatch between the mapping and the data and it implicitly contains prior knowledge about sensed data. In one example, mean-squared error techniques may be used to minimize the average squared error between the predictive module output and the target value (e.g., set via target setting module 1208) over all the data pairs. Minimizing this cost using gradient descent for the class of neural networks (multilayer perceptrons (MLP)) may be configured to produce a backpropagation algorithm for training neural networks. Utilizing supervised learning, ORC system predictive module 1102 may perform pattern recognition (classification) and regression (function approximation) to allow the system to provide continuous feedback on the quality of the models and the effects of particular control signals. Over time, the differences between the classifier module 1106 classification algorithms and the empirical system operation data, for the various parameters, will train/normalize and the ORC System Predictive Module 1100 will become more efficient at finding the optimal efficiency, and hence the optimal economic operation of the machine.

The control values 1108 and weighting module 1110 are advantageously coupled to predictive model module 1104 to provide adjustments to the control signals (e.g., via control signal values) being transmitted from ORC system predictive module 1102 and ORC components (e.g., relays, fans, valves, pumps, flow rates, temperature transmitters, pressure transmitters, etc.). Weighting module 1110 may be configured to provide weights to the data from module 1104 to make adjustments to the used model if the sensed data is producing excessive errors. As the ORC system operates and the control module 1100 operates and compares its models against empirical data, the solutions will narrow and become more effective. Under the supervision of predictive model module 1104, the existing model loaded in module 1104 may be changed to a new model utilizing the weights provided from module 1110. If the predictive errors fall below a predetermined threshold, the weighted model is saved (e.g., in 1010) for future use.

FIG. 12 shows another operating environment 1200 for the control module 1000 of FIG. 10 under an illustrative embodiment. The operating environment 1200 also includes the features of operating environment 1100. In the example of FIG. 12, control module operating environment 1202 comprises ORC system data 1204, modeling data 1206 and target setting module 1208. In one example, the ORC system data 1204 receives data sensed from the ORC system. The ORC system data is then processed (e.g., via 1002) using the modeling data 1206. In some illustrative embodiments, the modeling data 1206 may be received independently from the predictive model module (e.g., 1104). Modeling data 1206 is then processed (e.g., via 1002) with system performance data that is used in the target setting module 1208. The target setting module 1208 uses the modeling data to determine if sensed and/or predicted parameters are within predetermined system performance data parameters. The target setting module 1208 may provide feedback to the modeling data 1206, which may then re-process the modeling data using the new data provided by the target setting module 1208 and then loop the newly-processed data back to target setting module 1208. In this example, the modeling data 1206 is adjusted (e.g., via 1104) in accordance with the system performance data in target setting module 1208 to ensure that ORC system parameters, with respect to thermal recovery and system performance, are within predetermined tolerances of performance metrics. Once the modeling data 1206 is processed, the data is provided to the ORC system data 1204 that may then be used by the control module (e.g., 1000) to generate control signals that are transmitted wired or wirelessly to one or more ORC system components (e.g., relay, valve, pump. etc.) to modify operation based on the predictive data. Not only will these systems narrow in on the optimized net output of the ORC system, they will can be programmed to push the operating conditions in both directions (to add heat and to reject heat) to determine which direction the changes take the physical machines net output towards, trending and mapping the results for future considerations in order to optimize the output of the system. Just as much is learned from what doesn't improve performance as does to what does improve performance. Meaning, the system can learn not only what improves efficiency but also what hinders efficiency.

Figure 13:
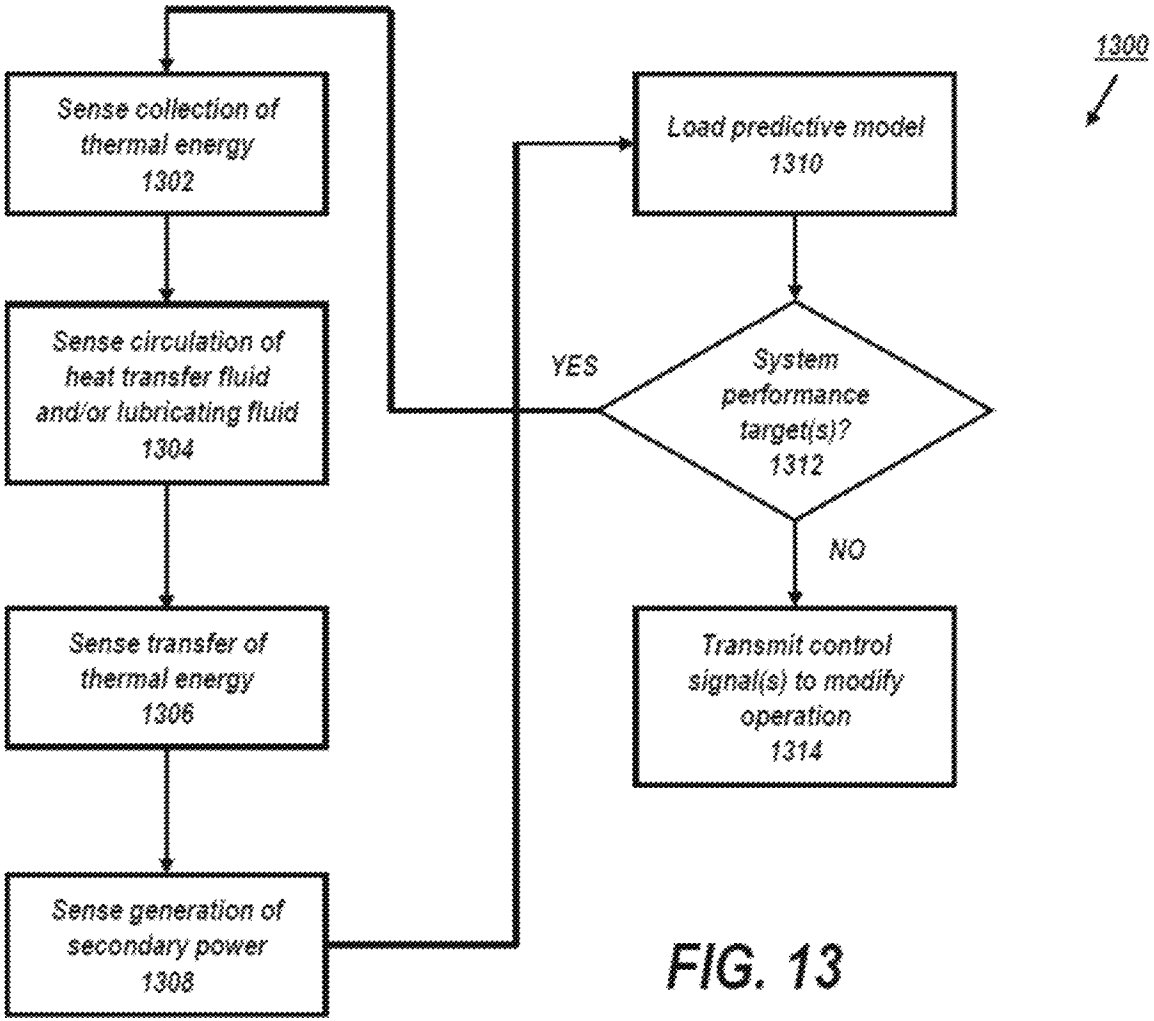
FIG. 13 is a flow diagram for sensing performance of an energy recovery system for loading a predictive model associated with a system performance target and for transmitting control signals to the energy recovery system to alter operation in accordance with one or more performance optimization targets.

FIG. 13 is a flow diagram illustrating a process 1300 for sensing performance of an energy recovery system for loading a predictive model associated with a system performance target and for transmitting control signals to the energy recovery system to alter operation in accordance with one or more performance targets. In block 1302, the ORC system (e.g., via 1000) senses, via sensors, the collection of thermal energy in block 1302 and stores the data. In block 1304, the ORC system senses via sensors the circulation of heat transfer fluid and/or lubricating fluid and stores the data. In block 1306, the ORC system senses the transfer of thermal energy in specific components and stores the data. In block 1308, the ORC system senses the generation of secondary power and stores the data. One any or all of blocks 1302-1308 are performed, the predictive model is loaded (e.g., 1104) and the data is processed.

In decision block 1312, the ORC system determines if the sensed data, processed through the predictive model (e.g., 1206) meets system performance targets. If the predictive model shows that the data meets system performance targets ("YES"), the process moves back to blocks 1302-1308, where various operating characteristics of the ORC system are sensed. If not ("NO"), the process moves to block 1314, where the processor (e.g., 100) transmits one or more control signals to modify operation of the ORC system.

In some examples, with new developments in materials for use in Thermo-Electric Generators (TEG), the integration of TEG's into commercial applications is becoming an economic possibility and therefore the technology is improving and the number of applications is increasing. To optimize a TEG's efficiency, generally high temperature differentials may be required to make their operation economic. Typically, because of the high temperature differential requirement, TEGs are typically used in engine exhaust heat recovery and that heat is then converted to electric power.

Without liquid cooling the TEG, the power generated from TEGs may be limited to the amount of air cooling that can be obtained. Air exchanging fins (or fin tubes) are limited in the amount of cooling based on the temperature of the air passed over them. When using ambient air, the colder the air is, the less air flow is required to achieve the same amount of cooling. If the ambient air is cooler and the amount of air flow remains constant, then there will be more cooling of the TEG and thus it will produce more power because of the increased temperature differential across the TEG. Air cooling of a TEG can be further be limited to physical space constraints within the proximity of the TEG. In warmer weather or in enclosed buildings that are heated, the amount of energy outputted from the TEG can be increased by liquid cooling the downside temperature of the TEG to increase temperature differential and keep the size of the TEG equipment a reasonable size. Although the temperature of the liquid cooling medium may not get lower than the ambient air temperature, the density of heat transfer can be increased because heat exchange to ambient air would happen in a radiator located away from the TEG. Meaning, you could have the TEG and the liquid cooling medium located anywhere (in a building, at a distance, etc.) even if the engine is located in a building. In the case of a reciprocating engine, they may be configured with at least one radiator to cool the engine (e.g., by collecting the engines radiant heat energy from combustion of the fuel) and then dissipating that heat energy through an air-cooled radiator. By using the engines cooling fluid (or a separate thermal fluid cooling medium), both the reciprocating engine and the TEG can benefit from improved operation and/or efficiency.

In the above example engine jacket water may be used for liquid cooling the TEG. Liquid cooling may be more efficient than air (liquid is a conductor and air is an insulator) and therefore the density of heat transfer is superior with liquid cooling. Meaning, heat may be removed from a "cold side" of the TEG by a liquid, so that a large temperature delta can be maintained regardless of the ambient (indoor) air temperature or the wind speed of that air (more wind speed is associated with more heat removal). With liquid cooling of the TEG, those issues may be eliminated, and the TEG equipment will generate more power, consistently, thereby getting the TEG to its full capacity because of the consistent and larger delta T than with an air cooled TEG. Thus, if there is limited heat take-away (because the air temp or flow is limited) the upper end of the TEG cannot exceed the upper limit because the heat source does not increase resulting in a compressed delta T across the TEG.

In some examples, the temperature of the liquid cooling medium may not get below ambient air temperatures because in most industrial systems, the liquid requires cooling. However, when combining liquid TEG cooling in combination with an engines existing radiator and an ORC system for cooling the liquid cooling medium, it creates an efficient and economic use of equipment. Further, the heat removed from the TEG can actually be utilized in the ORC to contribute to ORC power generation. In a normal liquid cooled TEG, the cooling liquid system may be considered parasitic to the TEG system because the liquid requires circulation and cooling in a radiator. Unless there is a natural cold water source available for cooling, in this arrangement, there is a symbiotic benefit to both the TEG, the ORC and the engine, because the engine already required and possessed a liquid cooling radiator system that can now be utilized by the other system components.

The amount of energy recovered from a TEG can be increased by configuring liquid cooling. In one example the downside temperature of a TEG may be liquid-cooled to increase temperature differential and keep the size of the TEG equipment a reasonable size. Incorporating an ORC system with a TEG, for example, to recover waste heat from a reciprocating engine, can provide additional advantages. Specifically, by transferring different grades and types of heat from the reciprocating engine to the TEG and/or the ORC system, in the various equipment combinations and embodiments discussed in greater detail below, the overall efficiency of the reciprocating engine, the TEG and the ORC system can be improved because an ORC system may only require heat in the 175° F. (and higher) range to make economic power whereas the TEG typically requires higher grade heat energy. Specifically, the heat rejected by the reciprocating engine's jacket water can be used to generate power in an ORC (but at the time of this application it is too cool to generate power in a TEG) however the engines exhaust can be used to generate power in either an ORC and/or a TEG. In one example, the engines exhaust can be diverted to a TEG first and then the remaining thermal energy (upon leaving the TEG) be recovered for use in an ORC system to generate more power than either system could as a standalone unit. Application of a control module 1000 would enable determination of the optimal temperature point to determine whether that engine exhaust should be diverted to the TEG or to the ORC or to both. The engines discharge jacket water also contains energy that can be used in an ORC system. Combining these heat streams and moving them between one another can produce a more efficient use and recovery of energy. Such a configuration may advantageously recover useable thermal energy and place it in optimal locations such that it improves the overall efficiency of the system. Heat rejected by the reciprocating engine can be used to power a TEG and/or an ORC or in application of low-grade heat such as district heating, building heating, heat tracing of pipes, etc. Additionally, heat rejected by the TEG can be used in an ORC system, and rejected heat from the TEG and ORC can be used, in certain illustrative embodiments, for low-grade uses such as district heating, building heating, process applications, bulk material drying, heat tracing of pipes, etc.

Under an illustrative embodiment, a heat transfer process may begin with fuel combustion in a diesel or spark ignition engine, which may be powered by bio-diesel, ethanol, natural gas, propane, field gas, gasoline, and/or diesel fuel, and the like. During operation, an engine may emit exhaust and radiant heat into the engines jacket water that may have that energy dissipated through the use of an air cooled (or other suitable) radiator. Other engine rejected heat may be dissipated via the lubricant and/or auxiliary cooling system (e.g., turbo cooling) and can be used in a similar manner described herein, provided its temperature fits into the ORC system or for other purposes. An ORC system can use rejected waste heat from any source to pre-heat, evaporate or superheat the working fluid (also known as propellant) and therefore insertion of that waste heat into locations in the ORC process where the working fluid (propellant) is at a lower temperature than the waste heat, is desired.

Heat rejected in an engine's exhaust (e.g., 1420) may pass through a TEG (e.g., 1404) that may generate power. The TEG may then discharge engine exhaust at a lower temperature. However, the exhaust may still contain usable energy for heat in an ORC system. At least some of the remaining cooled exhaust may then be vented to atmosphere (e.g., via a control valve) or used in the ORC system. In some illustrative embodiments, heat rejected or diverted by a reciprocating engine that is collected by the engine jacket water may be intercepted before it is dissipated in the radiator, and that energy can then be used in the ORC system. In addition to the energy in the jacket water, additional energy can be added to that heated jacket water in some illustrative embodiments by adding rejected heat from the TEG. In some illustrative embodiments, the cooling duty provided to the TEG may be configured as the additional heat to the jacket water which may be used in an ORC system. The order in which the heat is transferred from the TEG to the ORC is not always as described above however FIG. 15 shows the various paths the engines jacket water can take between the engine, the ORC and the TEG.

Various piping configurations and combinations described in greater detail below may produce optimal use of the rejected heat energy from the equipment and configurations described herein. In other words, many combinations of recovering waste heat from at least one of the engine, the TEG and the ORC system, and recycled to these components at appropriate insertion points into their respective processes may improve the efficiency of these (e.g., engine, TEG, and ORC) systems. As an example, on an ORC system, the addition of heat energy to the ORC system should be configured at a higher temperature than the ORC systems propellant such that heat flows from the waste heat source and into the ORC systems propellant that will then be used to generate power in the ORC system, thereby increasing the efficiency of the ORC.

As another example of building up heat transfer, the engine exhaust discharged from the TEG can also be used in the ORC. This energy can be collected and transferred to the ORC whether that be in a separate heat transfer medium/loop or by transfer to the engine's jacket water, with heat being collected from the reciprocating engine combined with the energy collected from cooling the TEG, in addition to heating the jacket water with the exhaust gases discharged from the TEG (see FIG. 15). Additionally, the engine exhaust discharged from the TEG can be transferred to the ORC either through a thermal fluid or directly venting the exhaust into the ORC system or to atmosphere via a gaseous control/diverting valve (not shown but similar to control valve 13). These types of opportunities exist to increase the efficiency of either each individually or collectively the reciprocating engines output, the TEG's output and/or the ORC's output.

Various configurations including various piping combinations and arrangements can be used to increase the overall energy efficiency of the reciprocating engine and adjoining system. Some examples are provided in U.S. patent application Ser. No. 16/761,492 to Victor Juchymenko, titled "System, Apparatus and Method for Managing Heat Transfer in Power Generation Systems", filed Nov. 5, 2018, the contents of which is incorporated by reference in its entirety herein. A mass balance, energy balance and thermodynamic calculations may be conducted on the engine/ORC/TEG to which the heat recovery equipment is coupled to, so that the appropriate configuration is applied. These calculations can be conducted by the heat recovery systems control module 1416 such that it dynamically adjusts the flow through the system (by controlling control valves 1408, 1418, pump 1412, or the fan in front of cooler 1410 (radiator) in FIG. 15) with the objective of improving the efficiency at which the system is operating. This may be based on the available waste heat energy sources, including, but not limited to, reciprocating engine exhaust, reciprocating engine jacket water, TEG cooling apparatus, exhaust discharge from the TEG, and/or thermal fluid discharge the TEG, and/or thermal fluid discharge from the ORC's heat exchangers (e.g., High-ORC, Mid-ORC and/or Low-ORC). Generally speaking, the terms Low-ORC, High-ORC, and Mid-ORC generally are not intended to reflect the relative operating temperatures to one another, but are only named differently to distinguish between them and highlight the fact that there can be multiple heat streams entering the ORC (e.g., alternately "first-ORC", "second-ORC", "third-ORC"). Specifically, those heat streams may be arranged such that the lowest temperature heat stream goes into the ORC at a point to interface with propellant that is at a lower temperature than the waste heat source entering the ORC system, and that the order in which the waste heat streams interface with the ORC may be rearranged such that waste heat is always adding energy to the ORC. As an example, the waste heat streams can be contributing to the ORC by pre-heating, evaporating or superheating the propellant in the ORC system 1406.

Figure 15:
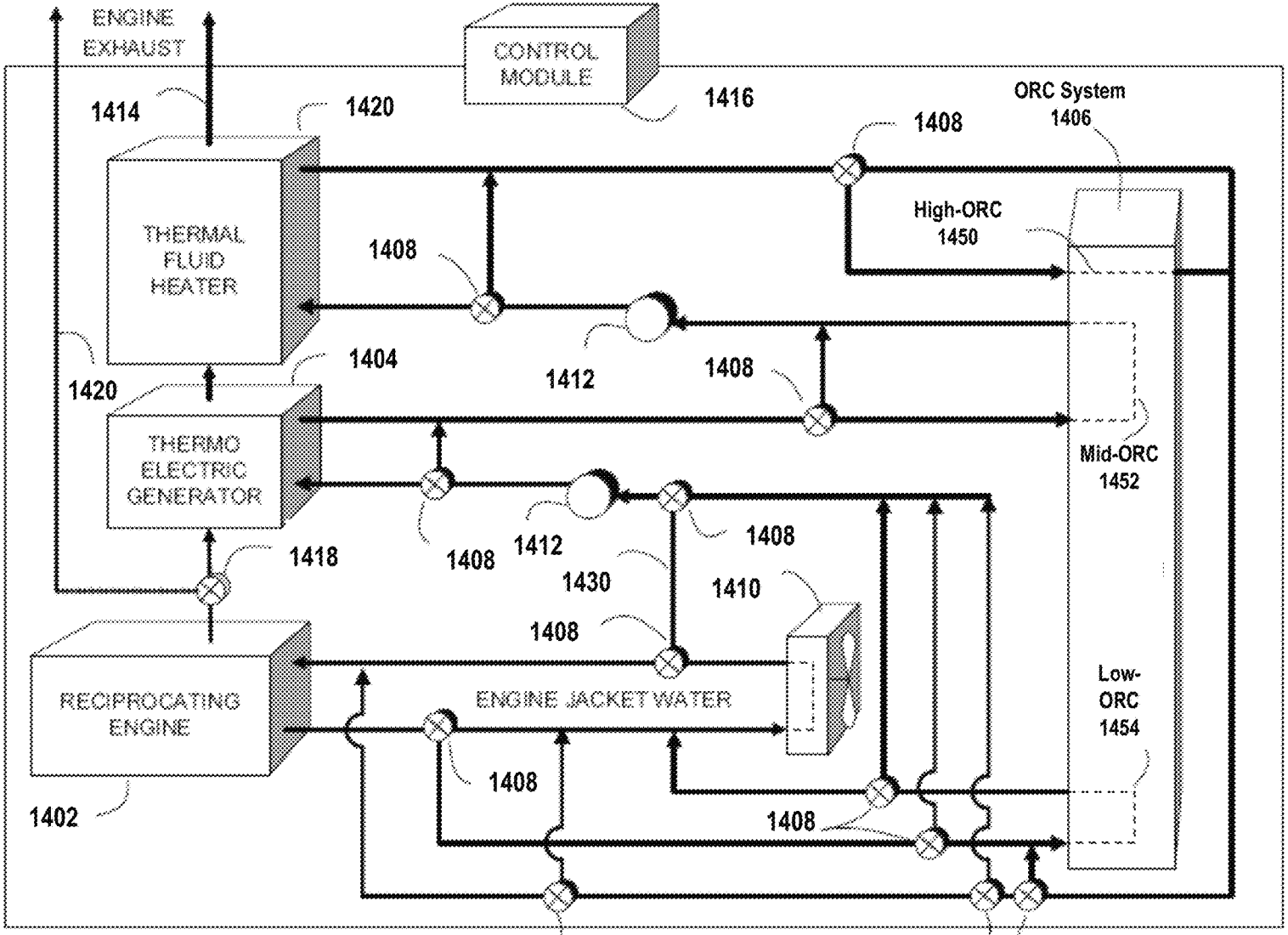
FIG. 15 shows yet another power generation system comprising a reciprocating engine, radiator, TEG, and thermal fluid heater coupled to an ORC system with circulating pumps control valves, wherein certain system controls may be provided by a predictive control module under an illustrative embodiment.

In some examples, control module 1416 may be configured similarly as control module 1000 described above in connection with FIGS. 10, control module 1100 described above in connection with FIG. 11, and control module 1200 described above in connection with FIG. 12 and is configured to control valves 1408, 1418, pump 1412, or the fan in front of cooler 1410 in FIG. 15.

It should be noted that different reciprocating engine makes and models may have different efficiencies from one another, as well as different proportional heat rejection to the exhaust and heat reject to the jacket water. Furthermore, two reciprocating engines of the same make and model could be configured differently with turbo chargers, varying turbo boost levels on those turbo's, varying thermostat opening temperature settings, etc. that affect the reject heat from an engine. Further yet, each reciprocating engine may have different operating conditions and loads (e.g., exhaust temperature, jacket water flow and temperature, etc.) thereby affecting the amount of heat being generated which will then affect the heat recovery equipment's operation. Accordingly, various configurations under the present disclosure may be tailored to suit a particular application having a desired (or optimal) performance/efficiency. In certain illustrative embodiments, control module 1416 may be configured to calculate the energy efficiency of any or all of the engine, TEG or ORC equipment during operation and adjust or alter the engine jacket water flow rates, flow paths, exhaust flow rates through various heat exchangers or TEG's, and throughout the system such that energy efficiency is improved with each controller induced change.

Control module 1416 may be configured as a processing device and include a processor or processor circuit, one or more peripheral devices, memory/data storage, and communication circuity, among other components as depicted in FIGS. 10-11. The processor for the control module 1416 may be embodied as any type of processor currently known or developed in the future and capable of performing artificial intelligence or other functions described herein. For example, the processor may be embodied as a single or multi-core processor(s), digital signal processor, microcontroller, or other processor or processing/controlling circuit. Similarly, the memory/data storage of control module 1416 may be embodied as any type of volatile or non-volatile memory or data storage currently known or developed in the future and capable of performing the functions described herein. In operation, memory/data storage may store various data and software used during operation of the control module 1416 such as access permissions, access parameter data, operating systems, applications, programs, libraries, and drivers. The memory/data storage of control module 1416 may be communicatively coupled to the processor via an I/O subsystem, which may be embodied as circuitry and/or components to facilitate input/output operations with the processor, memory/data storage, and other components of the control module 1416, whether the control module 1416 is programmed in such a manner or is a self-learning computing module. For example, the I/O subsystem may be embodied as, or otherwise include, memory controller hubs, input/output control hubs, firmware devices, communication links (i.e., point-to-point links, bus links, wires, cables, light guides, printed circuit board traces, etc.) and/or other components and subsystems to facilitate the input/output operations. In some embodiments, the I/O subsystem may form a portion of a system-on-a-chip (SoC) and be incorporated, along with the processor, memory/data storage, and other components of the control module 1416, on a single integrated circuit chip.

The communication circuitry (communication interface) for control module 1416 may include any number of devices and circuitry for enabling communications between control module 1416 and one or more other external electronic devices and/or systems. Control module 1416 may also include peripheral devices and may include any number of additional input/output devices, interface devices, and/or other peripheral devices. The peripheral devices may also include a display, and/or and HMI (human-machine-interface) along with associated graphics circuitry and, in some embodiments, may further include a keyboard, a mouse, audio processing circuitry (including, e.g., amplification circuitry and one or more speakers), and/or other input/output devices, interface devices, and/or peripheral devices.

The control module 1416 may also be configured to communicate with a network such as a wired and/or wireless network and may be or include, for example, a local area network (LAN), personal area network (PAN), storage area network (SAN), backbone network, global area network (GAN), wide area network (WAN), or collection of any such computer networks such as an intranet, extranet or the Internet (i.e., a global system of interconnected network upon which various applications or service run including, for example, the World Wide Web). The communication with control module 1416 may be direct or over a network or over the World Wide Web and can be configured to use any one or more, or combination, of communication protocols to communicate such as, for example, a wired network communication protocol (e.g., TCP/IP), a wireless network communication protocol (e.g., Wi-Fi, WiMAX), a cellular communication protocol (e.g., Wideband Code Division Multiple Access (W-CDMA)), and/or other communication protocols. Meaning, the various process outlined in FIG. 10 can be directly wired to one another, be on-board the same circuitry or be interfacing with one another a various remote location from one another. The above concepts are not limited to programmed equipment, they are also applicable to self-learning computing equipment that will optimize the overall energy efficiency of the components or the system. While not explicitly shown in the figures, those skilled in the art will appreciate that control module 1416 may be configured to communicate with other control modules of a heat recovery system, a central processing computer or center, using a Supervisory Control And Data Acquisition (SCADA) system, as well as sensors configured to sense environmental/system conditions during operation.

Figure 9:
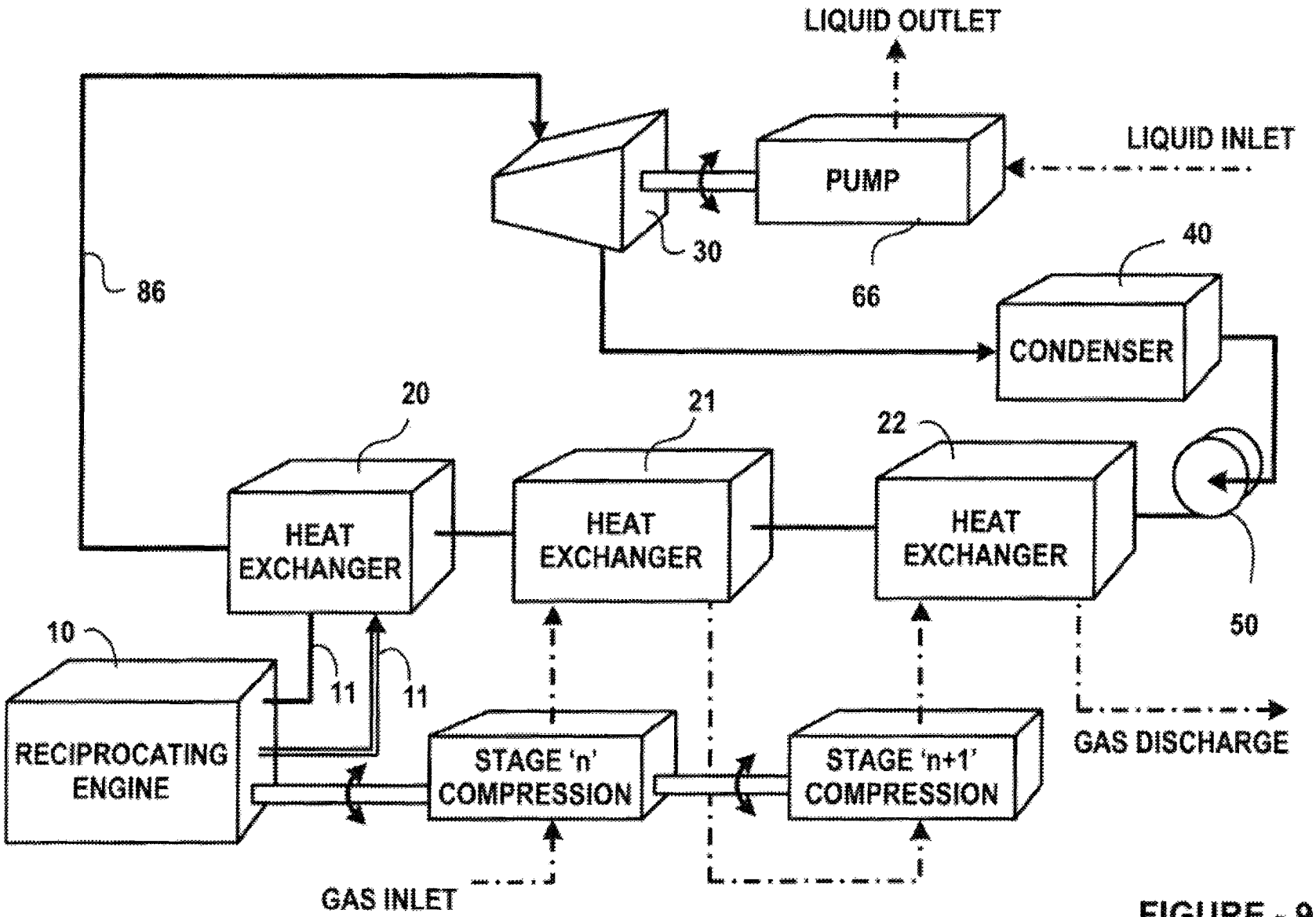
FIG. 9 is yet another simplified thermal energy recovery system under an illustrative embodiment.
Figure 14:
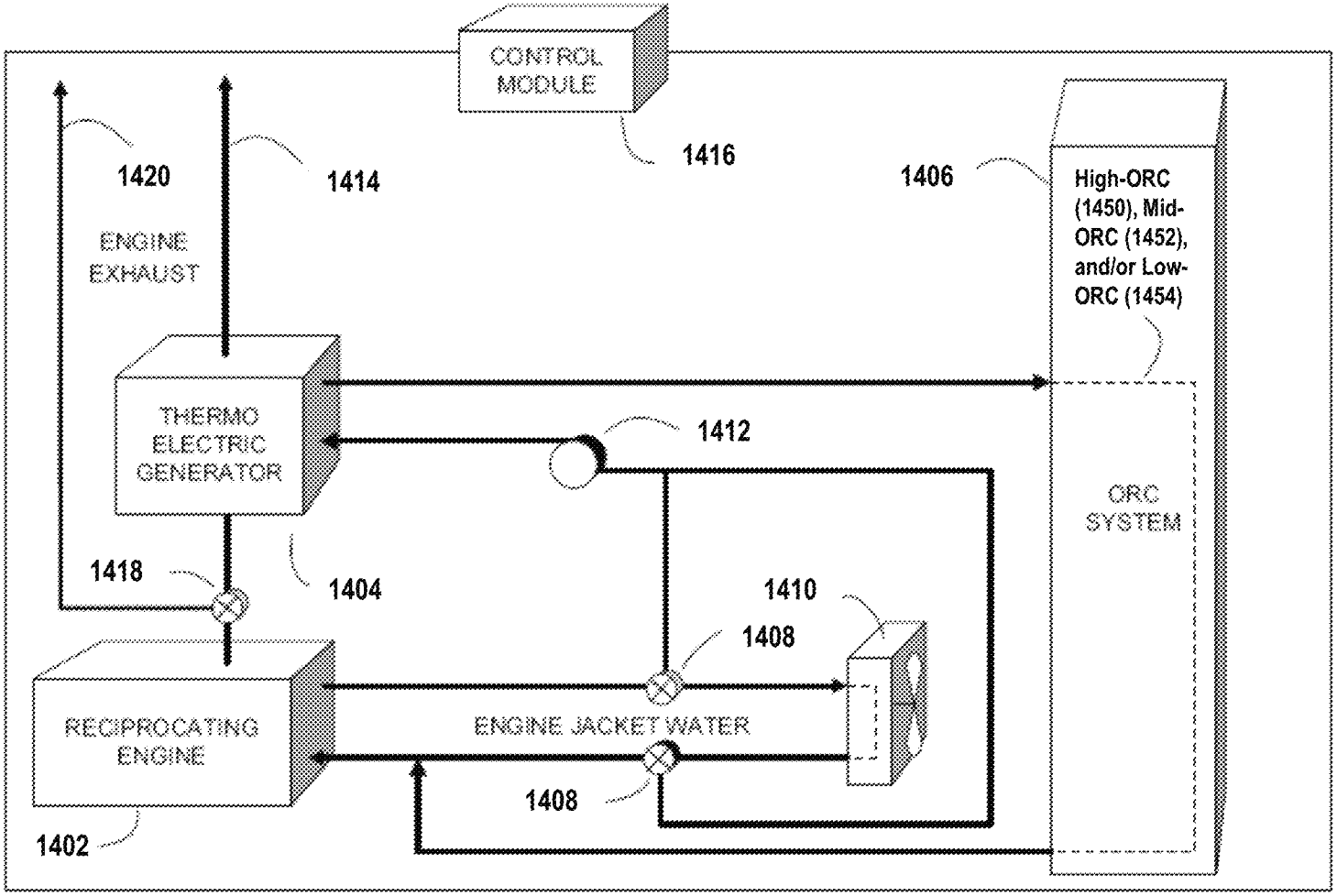
FIG. 14 shows a power generation system comprising a reciprocating engine, radiator and TEG coupled to an ORC system with circulating pumps control valves, wherein certain system controls may be provided by a predictive control module under an illustrative embodiment.

Turning to FIG. 14, the location and/or depiction of valves (labeled as 1408 for fluid valves and 1418 for engine exhaust valve) are generally intended to represent a flow diverting mechanism in which one valve or a series of valves operating together (e.g., via a control module or linkage system)

may divert a required flow to meet the objective of increased efficiency of the reciprocating engine 1402, TEG and/or ORC system. The inclusion of circulating pumps 1412 is implied and their illustrated location(s) are not intended to be limiting. One skilled in the art would readily understand that alternate and/or additional locations may be configured, depending on the application, which may require movement of fluids and/or gases, thereby requiring equipment to divert gases or flow fluids, as required. In some embodiments, the jacket water circulating pump(s) inherent to the reciprocating engines may not be engineered for the additional back pressure created by adding equipment to the reciprocating engines jacket water flow system. In such a configuration, changes to the existing pump or the addition of booster pumps may be required in the fluid process loops. For thermal fluid loops circulating a fluid between a thermal fluid heater located in the engines exhaust system and the ORC (not shown in the figures but is depicted in FIGS. 3, 6 and 9 of U.S. patent application Ser. No. 16/761,492, incorporated by reference in its entirety herein), the addition of a circulating pump may also be required. Conversely, a circulating pump on the exhaust pipe 1414 may not be required, provided the engines allowable exhaust back-pressure is considered in the design of the heat exchanger.

For certain illustrative embodiments discussed herein, it is to be understood that the reciprocating engine 1402 should be able to operate on its own, preferably without the burden of other equipment connected to it, ideally as if the heat recovery equipment was not connected. However, some back pressure is always created and provided that the heat exchangers in the ORC or the TEG and therefore effort should be placed into minimizing that back pressure effect onto the engine. If the back pressure cannot be avoided, then boost pumps or other support mechanisms will be required to overcome that back pressure burden on the engine, so the engine can operate as designed. A default configuration may be configured such that the engine exhaust is diverted by a valve (e.g., 1418) to atmosphere through an exhaust pipe (e.g., 1420), and the jacket water is piped to the engine's radiator (e.g., 1410) for cooling. If the piping configurations herein do not directly state this, it may be implied.

In the following, the below listed reference numbers represent illustrative apparatuses and orders or sequences (depicted as arrows in the text of the present specification) in which the thermal heat transfer fluids or the engine jacket water may flow (or in the case of exhaust gases, the order in which they flow) as depicted in each Figure:

| Reference No. | Apparatus |
|---|---|
| 1402 | Reciprocating Engine |
| 1404 | Thermo-Electric Generator (TEG) |
| 1420 | Heat Exchanger ("Thermal Fluid Heater") |
| 1450 | Heat Exchanger ("High-ORC") |
| 1454 | Heat Exchanger ("Low-ORC") |
| 1408 | Control Valves |
| 1410 | reciprocating engines radiator |
| 1412 | Circulating Pump |
| 1414 | Engine Heat Recovery Exhaust Pipe |
| 1416 | Control Module |
| 1418 | Engine Exhaust Control Valve |
| 1420 | Engine Bypass Exhaust Pipe |
| 1452 | Heat Exchanger ("Mid-ORC") |

The configuration of FIG. 14 may also be configured to create a relatively constant temperature differential across the TEG (thus avoiding thermal cycling of the TEG or ORC components) because, at a constant (specified) load, the engine emits a relatively constant exhaust temperature and the engines internal thermostat only discharges jacket water when it reaches the temperature setting of the thermostat, eventually reaching a steady state of jacket water flow and at a particular discharge temperature as steady state of reject heat to the power output of the engine. In some illustrative embodiments, the engine's exhaust may be discharged through exhaust pipes 1414 and 1402 and may be generally constant when being discharged from the reciprocating engine and therefore the temperature differential across the TEG 1402 should be relatively constant.

Control module 1416 may be configured to predictively monitor the temperature of the jacket water returning to the reciprocating engine 1402 and then modulate or adjust control valves 1408 to vary the flow through the respective piping arrangements (e.g., to the heat recovery equipment or the radiator 1410) so that appropriate return temperature ranges are maintained. A further detail in return temperature control can be the use of splitting the flow into multiple streams concurrently and allowing the streams to merge at another point in the process. This concept should be applied to virtually all configurations where the engines radiator 1410 can be operated in parallel to one or more other components such that the flow is split to the radiator 8 and that other component (TEG 1404, Thermal Heating Fluid (THF) 1402, heat exchangers High-ORC 1415, Mid-ORC 1452, or Low-ORC 1454) or to a multiplicity of components in series with one another before merging the flow streams with the flow from the radiator 1410 and the flow streams going through the other component(s). This method of control and process flow will increase the efficiency of the individual equipment if operated independently and thus will increase efficiency of the configurations depicted below and thus the concept should be understood to be applied in any of the figures or configurations disclosed herein. It should be noted that the split flow can occur at the beginning, the middle or towards the end of the flow loop originating at the reciprocating engine. Meaning, wherever the flow can be split off to divert a portion of the flow to the radiator, and then have that flow merge with the stream that flowed to the other stream (such that they always merge before re-entry to the reciprocating engine), then all combinations can work, and would be suitable methods for return jacket water temperature control. At substantially the same time, the control module 1416 may also make appropriate adjustments to the amount of air flow across the radiator by varying the fan speed or blade pitch operating in front of the engines radiator 1410 and make adjustments to the equipment within the ORC system 1406. This objective can also be accomplished by diverting exhaust gases around the TEG 1404 and the Thermal Fluid Heater (TFH) 1402 by controlling valve 1418 to divert some or all of the engine exhaust into piping 14. With the complexity of the combinations and permutations of diverting heat flows, ambient air temperatures, pump speeds, etc. it becomes apparent why a reactive control module would be limited in its ability to optimize the performance of the ORC/TEG/engine configuration and how a smart control module 1416 would benefit the operation of such a system.

In natural gas compression arrangements, the jacket water cooling radiator may be bundled in an aerial cooler with other fin tube radiator-type sections (used to cool the compressed gas), and the aerial cooler is equipped with a large cooling fan to draw ambient air across the radiator sections. In gas compression this aerial cooler fan may typically be powered by the reciprocating engine. In order to operate the system as described above, the fan drive should be decoupled from the reciprocating engine and converted to electric drive (e.g., with a variable frequency drive (VFD)) so that power generated by the TEG or the ORC can be used to power the aerial cooler fan. Also, in natural gas compression cooling, the determining factor to run the cooling fan may at times be dictated by the amount of cooling the jacket water requires or at times by the amount of cooling the compressed gas requires. This configuration further emphasizes how a smart (predictive) control module 1416 would benefit the operation of such a system.

The component configurations disclosed herein illustrate exemplary orders in which thermal fluid may flow and in other illustrative embodiments not expressly disclosed herein should be appreciated by one skilled in the art. Where a '/' sign is used, it is to indicate a split in the flow in the configurations and the flow is then assumed to take the path of least resistance until the flows merge again at an appropriate convergence point. In some examples, a separate thermal loop may be configured, in which a separate thermal fluid or exhaust gas is used to move thermal energy around the system. For example, a designation 1402→1410/1404→1450→1402 illustrates that the flow from reciprocating engine 1402 to radiator 1410 (i.e., 1402→1410) is split to the TEG 1404 and the radiator 1410 by the control valve 1408 that is located between the reciprocating engine 1402 and the radiator 1410 (which can also be described to be positioned between the reciprocating engine 1402 and the TEG 1404). One partial stream of the total flow, flows through radiator 1410 and the remaining portion of the total flow flows through the TEG 1404 which then goes on to flow through the ORC system (High-ORC 1450) which returns flow back to reciprocating engine 1402 (i.e., 1404→1450→1402) where it is merged with the other part of the flow that circulated through radiator 1410 (i.e., 1402→1410), prior to entering the reciprocating engine.

Furthermore, it should be appreciated by those skilled in the art that the specific sequences are illustrative only, and are not intended to be limiting. Alternate or additional sequences are contemplated in the present disclosure. In certain illustrative embodiments, sequences starting with a particular component (e.g., reciprocating engine 1402) that "circle back" to the component (e.g., 1402→1410→1404→1450→1402) may be considered a closed-loop configuration, where a component from which a sequence starts also may serve as the ending point of the sequence. Specifically, because the source of the thermal energy is usually originated by the reciprocating engine 1402, the sequencing/numbering applied starts and finishes at the reciprocating engine 1402, but can be shown starting at any other point in the sequence and finishing back at that sequence.

Various illustrative configurations for FIG. 14:

Configuration 1:
1402→1404→1450→1402

Configuration 2:
1402→1404→1454→1402

Configuration 3:
1402→1404→1452→1402

Configuration 4:
1402→1410→1402+1420

Configuration 5:
1402→1410→1404→1450→1402

Configuration 6:
1402→1410→1404→1452→1402

Configuration 7:
1402=1410→1404→1454→1402

Configuration 8:
1402→1410/1404→1450→1402 (split flow between 1404 and 1410)

Configuration 9:
1402→1410/1404→1454→1402 (split flow between 1404 and 1410)

Configuration 10:
1402→1410/1404→1452→1402 (split flow between 1404 and 1410)

Turning to FIG. 15, a configuration is disclosed wherein ORC system heat exchanger Low-ORC 1454 may be used early in the heat transfer process or at the end of a heat transfer process. In other words, depending on where the jacket water temperatures are landing with a specific engine, it may be beneficial to use heat exchanger Low-ORC 1454 for pre-heating or evaporating or super-heating propellant (depending on the ORC's propellant used and system pressure) before the jacket water is returned to the reciprocating engine 1402.

As described in elsewhere herein, the reciprocating engine radiator 1410 can be operated in series or in parallel to the ORC or TEG waste heat recovery system. This may be accomplished by the addition of pipe spool 1430 which depending on the case, can see flow in either direction depending on the valve 1408 configurations applied by the control module 1416. Additionally, splitting the jacket water flow (whether configured to operate the radiator 1410 in series or in parallel), diverting partial flow to the radiator and allowing the fluids to circulate, final adjustment of the returning jacket water can be made when the radiator is operated near the end of the jacket waters circulation, before returning to the reciprocating engine 1402. This concept is applicable to other flows passing through control valves where the control valve would divert fluid (or exhaust) flow to varying components and by changing the flow, the amount of energy delivered also varies, causing the receiving equipment to operate differently than it would with different flow rate delivered to it.

In some examples, the system of FIG. 15 may be configured to operate as two separate thermal loops where the reciprocating engine 1402 and the radiator 1410 operate independently from the TEG 1404 and the ORC system 1406. This may be accomplished by the control module 1416 adjusting control valves 1408 such that flow of engine radiator fluid from the reciprocating engine is isolated to flow only from the reciprocating engine 1402 to the radiator 1410 and back to the reciprocating engine 1402. This leaves the balance of the waste heat system isolated from the radiator fluid where the fluid in that part of the system is circulated by circulation pump 1412.

In some examples, the reciprocating engine 1402 jacket water may be circulated throughout the waste heat system, and may include: reciprocating engine 1402, jacket water cooling fluid, TEG 1404, TFH 1420, ORC system 1406, High-ORC 1450, Mid-ORC 1452, Low-ORC 1454, Control valves 1408, reciprocating engine radiator 1410, circulating pump(s) 1412, engine exhaust pipes 1414 and 1420, pipe spool 1430, control module 1416, and exhaust control valve 1418. With the addition of pipe spool 1430, fluid can flow in either direction, depending on whether the reciprocating engine radiator is operated in series or in parallel to the waste heat recovery system.

During operation, the predictive system (e.g., utilizing control module 1416) may be configured to maximize reciprocating engine efficiency or achieve one or more configured operating parameters by controlling the fluid flow through the various components, all the while targeting the fluid temperature returning to the reciprocating engine to be at the target temperature range so that the engines thermostatic valve does not restrict jacket water discharge from the reciprocating engine 1402 nor does it allow the engine to overheat due to inadequate cooling of the jacket water.

In some examples, one of the sub-objectives influencing the control modules 1416 algorithm(s) or self-learning (artificial intelligence) software should be to minimize the temperature of the jacket water entering the TEG 1404 so as to increase the delta across the TEG 1404. Another factor to be programmed into the control algorithm is the operation of the ORC system 1406. That is, fluid temperature and flow should be compared to the result that will be achieved in the ORC system 1406 versus the TEG 1404, all the while ensuring that the return temperature of the reciprocating engine jacket water has extracted the appropriate thermal energy from the engine such that the thermostatic valve inherent to the engine does not modulate unnecessarily. The algorithm will need to compare the expected output while also modulating flow in the system to extract the correct amount of thermal energy from the reciprocating engines jacket water to achieve the appropriate return temperature of the jacket water to the reciprocating engine 1402.

The piping arrangement shown allows for cooling in the existing radiator either before reaching the TEG (with the objective to reduce the temperature of the jacket water to the TEG's inlet for the purpose of increasing the temperature delta across the TEG to increase its efficiency) or after the TEG (prior to return to the engine) so that the system does not affect the engines internal thermostatic (temperature dependent position) valve or in extreme conditions, overheat and shut down the engine or modulate flow to increase the jacket waters temperature by having a longer residence time in the engine.

In some examples, the system of FIG. 15 may be configured to bypass the TEG 1404, the Mid-ORC 1452, the TFH 1420, and, alternately or in addition, bypass around the ORC system's 1406 heat exchanger High-ORC 5. Therefore, between the addition of jacket water flow through the reciprocating engine 1402 radiator 1410 in series or parallel and bypass on the heat producing and heat consuming elements of the waste heat system, the control module can maximize the efficiency of the reciprocating engine 1402 by manipulating the flow of fluids through the collection and rejection of heat from the reciprocating engine using the TEG 1404, ORC system 1406, and engine radiator 1410.

Through the various flow paths, by controlling the control valves 1408, virtually any combination of components can be used to either input heat into the thermal fluids or take heat out of the thermal fluids such that the objective of optimized efficiency is achieved without disrupting the operation of the reciprocating engine 1402.

Various illustrative configurations for FIG. 15

Configuration 1:
1402→1404→1420→1402
Configuration 2:
1402→1404→1420→1450→1402
Configuration 3:
1402→1404→1420→1450→1410→1402
Configuration 4:
1402→1404→1420→1450→1454→1402
Configuration 5:
1402→1404→1420→1450→1454→1410→1402
Configuration 6:
1402→1404→1420→1454→1402
Configuration 7:
1402→1404→1420→1454→1410→1402
Configuration 8:
1402→1404→1420→1410→1402
Configuration 9:
1402→1404→1450→→1402
Configuration 10:
1402→1404→1450→1454→1402
Configuration 11:
1402→1404→1450→1454→1410→1402
Configuration 12:
1402→1404→1450→1410→1402
Configuration 13:
1402→1404→1454→1410→1402
Configuration 14:
1402→1404→1454→1402
Configuration 15:
1402→1404→1410→1402
Configuration 16:
1402→1404→1452→1420→1402
Configuration 17:
1402→1404→1452→1420→1450→1402
Configuration 18:
1402→1404→1452→1420→1450→1410→1402
Configuration 19:
1402→1404→1452→1420→1454→1402
Configuration 20:
1402→1404→1452→1420→1454→1410→1402
Configuration 21:
1402→1404→1452→1450→1402
Configuration 22:
1402→1404→1452→1450→1454→1402
Configuration 23:
1402→1404→1452→1450→1454→1410→1402
Configuration 24:
1402→1404→1452→1450→1410→1402
Configuration 25:
1402→1404→1452→1454→1402
Configuration 26:
1402→1404→1452→1454→1410→1402
Configuration 27:
1402→1404→1452→1402
Configuration 28:
1402→1404→1402
Configuration 29:
1402→1420→1450→1410→1402
Configuration 30:
1402→1420→1450→1402
Configuration 31:
1402→1420→1454→1410→1402
Configuration 32:
1402→1420→1454→1402
Configuration 33:
1402→1450→1454→1410→1402
Configuration 34:
1402→1450→1454→1402
Configuration 35:
1402→1450→1410→1402
Configuration 36:
1402→1450→1402
Configuration 37:
1402→1454→1404→1420→1402
Configuration 38:
1402→1454→1404→1420→1450→1402
Configuration 39:
1402→1454→1404→1420→1450→1410→1402
Configuration 40:
1402→1454→1404→1420→1410→1402

Configuration 41:
1402→1454→1404→1450→1402
Configuration 42:
1402→1454→1404→1450→1410→1402
Configuration 43:
1402→1454→1404→1410→1402
Configuration 44:
1402→1454→1404→1452→1402
Configuration 45:
1402→1454→1404→1452→1420→1402
Configuration 46:
1402→1454→1404→1452→1420→1450→1402
Configuration 47:
1402→1454→1404→1452→1420→1410→1402
Configuration 48:
1402→1454→1404→1452→1450→1402
Configuration 49:
1402→1454→1404→1452→1450→1410→1402
Configuration 50:
1402→1454→1404→1452→1410→1402
Configuration 51:
1402→1454→1404→1402
Configuration 52:
1402→1454→1420→1450→1402
Configuration 53:
1402→1454→1420→1450→1410→1402
Configuration 54:
1402→1454→1420→1410→1402
Configuration 55:
1402→1454→1420→1402
Configuration 56:
1402→1454→1450→1410→1402
Configuration 57:
1402→1454→1450→1402
Configuration 58:
1402→1454→1410→1404→1402
Configuration 59:
1402→1454→1410→1404→1452→1402
Configuration 60:
1402→1454→1410→1404→1452→1420→1402
Configuration 61:
1402→1454→1410→1404→1452→1420→1450→1402
Configuration 62:
1402→1454→1410→1404→1452→1450→1402
Configuration 63:
1402→1454→1410→1404→1420→1402
Configuration 64:
1402→1454→1410→1404→1420→1450→1402
Configuration 65:
1402→1454→1410→1404→1450→1402
Configuration 66:
1402→1454→1410→1404→1402
Configuration 67:
1402→1454→1410→1404→1452→1402
Configuration 68:
1402→1454→1410→1404→1452→1420→1450→1402
Configuration 69:
1402→1454→1410→1404→1452→1450→1402
Configuration 70:
1402→1454→1410→1404→1420→1402
Configuration 71:
1402→1454→1410→1404→1420→1450→1402
Configuration 72:
1402→1454→1410→1404→1450→1402
Configuration 73:
1402→1454→1410→1402
Configuration 74:
1402→1454→1402
Configuration 75:
1402→1410→1404→1420→1402
Configuration 76:
1402→1410→1404→1420→1450→1402
Configuration 77:
1402→1410→1404→1420→1450→1454→1402
Configuration 78:
1402→1410→1404→1420→1454→1402
Configuration 79:
1402→1410→1404→1450→1402
Configuration 80:
1402→1410→1404→1450→1454→1402
Configuration 81:
1402→1410→1404→1454→1402
Configuration 82:
1402→1410→1404→1410→1402
Configuration 83:
1402→1410→1404→1452→1402
Configuration 84:
1402→1410→1404→1452→1420→1402
Configuration 85:
1402→1410→1404→1452→1420→1450→1402
Configuration 86:
1402→1410→1404→1452→1420→1454→1402
Configuration 87:
1402→1410→1404→1452→1450→1402
Configuration 88:
1402→1410→1404→1452→1454→1402
Configuration 89:
1402→1410→1404→1452→1420→1454→1402
Configuration 90:
1402→1410→1404→1452→1420→1450→6→1402
Configuration 91:
1402→1410→1404→1402
Configuration 92:
1402→1410→1420→1450→1402
Configuration 93:
1402→1410→1420→1450→1454→1402
Configuration 94:
1402→1410→1420→6→1402
Configuration 95:
1402→1410→1420→1402
Configuration 96:
1402→1410→1450→1454→1402
Configuration 97:
1402→1410→1450→1402
Configuration 98:
1402→1410→1454→1402
Configuration 99:
1402→1410→1410→1402
Configuration 100:
1402→1410→1452→1420→1402
Configuration 101:
1402→1410→1452→1420→1450→1402
Configuration 102:
1402→1410→1452→1420→1454→1402
Configuration 103:
1402→1410→1452→1450→1402
Configuration 104:
1402→1410→1452→1450→1454→1402
Configuration 105:
1402→1410→1452→1454→1402
Configuration 106:
1402→1410→1452→1402
Configuration 107:
1402→1410→1402

Configuration 108:
1402→1452→1420→1450→1402
Configuration 109:
1402→1452→1420→1450→1410→1402
Configuration 110:
1402→1452→1420→1454→1402
Configuration 111:
1402→1452→1420→1454→1410→1402
Configuration 112:
1402→1452→1420→1402
Configuration 113:
1402→1452→1450→1454→1402
Configuration 114:
1402→1452→1450→1454→1410→1402
Configuration 115:
1402→1452→1450→1410→1402
Configuration 116:
1402→1452→1450→1402
Configuration 117:
1402→1452→1454→1410→1402
Configuration 118:
1402→1452→1454→1402
Configuration 119:
1402→1452→1402

In some examples, the engines radiator 1410 may be available to be operated in series or in partial-parallel (by splitting the flow to the radiator 1410 and other components simultaneously) to the entire heat recovery system. In some illustrative embodiments, partial-parallel flow may be configured at any control valve, depending on the application. When heat recovery is desired, the reciprocating engines radiator 1410 becomes important to the heat recovery system and may be used in series. In some illustrative embodiments, the flow from the reciprocating engine 1402 can be split between the radiator 8 and heat exchanger Low-ORC 1454. This split flow will provide heat to the ORC system 1406 and cooling the balance of the jacket water from the engine, thereby creating a proportioning flow system that can be used for jacket water return temperature control. In some illustrative embodiments, the return temperature of the jacket water to the reciprocating engine can be controlled by the control module 1416 by either flow diversion through any of the control valves (e.g., 1408) or by diverting reciprocating engine exhaust gases using valve 1418 into the engine exhaust pipe 1420 around the TEG 1404 and TFH 1420 such that the circulating fluid will not capture as much heat from the reciprocating engines exhaust, or split the exhaust flow between exhaust pipe 1414 (with the two heat recovery elements) and exhaust pipe 1420.

In one example, the engines jacket water may be first circulated to the ORC systems heat exchanger Low-ORC 1454 which cools the jacket water. It may then be circulated to the reciprocating engines radiator 1410 for additional cooling. The jacket water then may then be piped to the TEG 1404 to provide the TEG cooling. This is one of the coolest streams of jacket water possible in the described configurations because it is cooled in series by the ORC system and the reciprocating engines radiator 1410, thereby providing the largest temperature delta to the TEG 1404. The jacket water may then be heated by the TEG 1404 (while cooling the TEG 1404) and is then heated by the remaining recoverable (to the lower temperature limit) energy in the reciprocating engines exhaust that discharges from the TEG 1404 in the thermal fluid heater TFH 1420. The jacket water may then be piped to the ORC systems heat exchanger High-ORC 1450 or Mid-ORC 1452. The jacket water is cooled here and then returned to the reciprocating engine 1402 to repeat the process.

In some examples, a control module (e.g., 1416, 1000, 100) may be configured with an ANN using any of a number of ORC operating input parameters (e.g., engine speed, engine torque, engine load, engine exhaust temperature/flow rate, engine jacket water reject temperature (dependent on thermostatic settings) and associated flow rate, pump speed/flow, expander speed, evaporation pressure, condensing pressure, mass flow rate of working fluid, heat source temperatures, control valve position, exhaust diversion, heat source flow rates, ambient air temperature, propellant temperatures/pressures/flow rates, various ORC system parasitic loads, various engine parasitic loads, etc.) to determine an operational mode of the ORC and adjust operational functions to achieve a desired operational mode. The control may be achieved using a closed-loop or open-loop control. The ANN architecture may be configured with a number of parameters that define a vector of inputs, a number of hidden layers of the network, and the number of neurons in each layer. Generally speaking, the higher the number of layers and the number of neurons in each layer, the more complex is the function the network can predict with a high degree of accuracy. The ANN model may define a function that approximates unknown functions underlying the operating process. The ANN may then be trained on a number of existing instances, based on one or more vectors representing features of the input and a corresponding output. The training may be configured to solve an ORC optimization problem, in which a means-squared error of the network in predicting known instances is minimized. In some examples, a single hidden layer may be utilized to solve a given ORC optimization problem. In other examples, a plurality of hidden layers (e.g., deep learning network) may be utilized. In some example, a feed-forward neural network, a recurrent neural network or a long-short-term memory network may be utilized in the control module for predictive processing.

During operation, a control module (e.g., 1416, 1000, 1100, 1200, and 100) operating on a skid may be configured to predictively model and execute operation on any or all stages of operation, or combination of stages of functioning in an ORC system, including but not limited to startup, warming up fluids, heat soaking the steel on a skid, spinning and synchronization, running/operation, cool-down and/or shut-down. Using any of the technologies and techniques disclosed herein, ORC operators may achieve desired operational parameters (economies) by influencing any single or multiple stages of ORC operation.

The figures and descriptions provided herein may have been simplified to illustrate aspects that are relevant for a clear understanding of the herein described devices, structures, systems, and methods, while eliminating, for the purpose of clarity, other aspects that may be found in typical similar devices, systems, and methods. Those of ordinary skill may thus recognize that other elements and/or operations may be desirable and/or necessary to implement the devices, systems, and methods described herein. But because such elements and operations are known in the art, and because they do not facilitate a better understanding of the present disclosure, a discussion of such elements and operations may not be provided herein. However, the present disclosure is deemed to inherently include all such elements, variations, and modifications to the described aspects that would be known to those of ordinary skill in the art.

Exemplary embodiments are provided throughout so that this disclosure is sufficiently thorough and fully conveys the scope of the disclosed embodiments to those who are skilled in the art. Numerous specific details are set forth, such as examples of specific components, devices, and methods, to provide this thorough understanding of embodiments of the present disclosure. Nevertheless, it will be apparent to those skilled in the art that specific disclosed details need not be employed, and that exemplary embodiments may be embodied in different forms. As such, the exemplary embodiments should not be construed to limit the scope of the disclosure. In some exemplary embodiments, well-known processes, well-known device structures, and well-known technologies may not be described in detail.

The terminology used herein is for the purpose of describing particular exemplary embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The steps, processes, and operations described herein are not to be construed as necessarily requiring their respective performance in the particular order discussed or illustrated, unless specifically identified as a preferred order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another element, component, region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the exemplary embodiments.

The disclosed embodiments may be implemented, in some cases, in hardware, firmware, software, or any tangibly-embodied combination thereof. The disclosed embodiments may also be implemented as instructions carried by or stored on one or more non-transitory machine-readable (e.g., computer-readable) storage medium, which may be read and executed by one or more processors. A machine-readable storage medium may be embodied as any storage device, mechanism, or other physical structure for storing or transmitting information in a form readable by a machine (e.g., a volatile or non-volatile memory, a media disc, or other media device).

In the drawings, some structural or method features may be shown in specific arrangements and/or orderings. However, it should be appreciated that such specific arrangements and/or orderings may not be required. Rather, in some embodiments, such features may be arranged in a different manner and/or order than shown in the illustrative figures. Additionally, the inclusion of a structural or method feature in a particular figure is not meant to imply that such feature is required in all embodiments and, in some embodiments, may not be included or may be combined with other features.

In the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separate embodiment.

What is claimed is:

1. A system for collection and conversion of thermal energy to mechanical and/or electric energy, the system comprising:

a thermal energy recovery system for waste heat recovery, comprising an Organic Rankine Cycle (ORC) comprising a propellant heat exchanger, an expander and a condenser, and one or more heat exchangers comprising a heat medium for transferring waste heat from a combustion device to ORC propellant in the propellant heat exchanger for ORC operation;

sensors, operatively coupled to the thermal energy recovery system, the sensors being configured to produce system sensor data comprising operational data associated with environmental conditions and ORC-based operational parameters;

a control circuit comprising a predictive module, wherein the predictive module comprises operational parameters trained on a neural network using node-based pattern classification and regression tailored for ORC net power optimization by capturing non-linear relationships and temporal sequences characteristic of the ORC system's operation and configured to operate the thermal energy recovery system of the system under configured target operational values, based on operational conditions comprising waste heat recovery and secondary power generation from the ORC, for maximizing net power output from the ORC, wherein the control circuit is configured to receive and process the produced sensor data to evaluate whether the thermal energy recovery system is projected to deviate from the target operational values within a configured time period, and wherein the control circuit is configured to transmit control signals to dynamically modify operation of the thermal energy recovery system such that further produced system sensor data meets the target operational values, wherein the control signals are configured to adjust thermal or operational conditions of the system by modifying heat input and heat extraction of at least two thermal sources comprising thermal fluids, jacket water, exhaust and/or ORC propellant to meet the target operational values.

2. The system of claim 1, wherein the operational parameters comprise one or more of ORC operational parameters, thermo-electric generator (TEG) operational parameters, engine operational parameters, gas compressor operational parameters and general operational parameters, wherein the ORC operational parameters comprise one or more of:

power generated by the expander, expander speed, ORC system parasitic loads, ORC propellant temperatures throughout an ORC process, ORC propellant pressures throughout the ORC process, ORC mass flow rate of propellant working fluid, and thermal fluid temperature and/or flow rates entering and exiting the ORC, wherein the TEG operational parameters comprise one or more of:

TEG power generation, engine jacket water entering and exiting the TEG, engine exhaust temperature entering and exiting the TEG, and thermal fluid temperature entering and exiting the TEG, wherein the engine operational parameters comprise one or more of:

engine speed, engine load, engine torque, engine parasitic loads, radiator fan speed, radiator fan load, engine jacket water temperatures, engine jacket water flow rate, engine jacket water discharge from engine temperature, engine jacket water return to engine temperature, engine jacket water discharge from radiator temperature, engine jacket water discharge to radiator temperature, engine exhaust flow rate, and engine exhaust temperature, wherein the gas compressor operational parameters comprise one or more of:

gas compressor flow rate, gas compressor temperatures in and/or out of each stage of compression, gas compressor jack shaft speed, gas compressor jack shaft torque, and wherein the general operational parameters throughout the system comprise one or more of:

thermal fluid temperatures, pressures and/or flow rates, engine jacket water temperatures pressures and/or flow rates, engine exhaust temperatures, pressures and/or mass flow rates, propellant temperatures, control valves position information, electric drives motor speed, electric drives motor torque, pump flow rates and/or pressures, generator output, and ambient air temperature.

3. The system of claim 1, wherein at least one of an engine radiator and/or the condenser of the ORC is configured to provide cooling capability to a cooling side of a thermo-electric generator (TEG).

4. The system of claim 1, wherein the operational parameters are configured as a predictive model comprising one or more instances based on one or more vectors of the neural network representing features of an input and a corresponding output relating to one or more target operational values.

5. The system of claim 4, wherein the predictive model comprises classifier data associated with pattern recognition performed on previous sensor data.

6. The system of claim 5, wherein the control circuit is configured to map the produced sensor data with the classifier data.

7. The system of claim 1, wherein the control signals are configured to control thermal energy from a thermal energy source and ORC in the system to meet the target operational values without disrupting the operation of the system.

8. The system of claim 1, wherein the control signals are configured to control flow paths in the system to either input heat into, or take heat out of the exhaust, thermal fluids and/or the jacket water and/or ORC propellant to meet the target operational values without disrupting the operation of the system.

9. A method for collection and conversion of thermal energy to mechanical energy in a system, comprising:

receiving system sensor data from a thermal energy recovery system for waste heat recovery comprising operational data associated with environmental conditions and ORC-based operational parameters, the thermal energy recovery system comprising an Organic Rankine Cycle (ORC) comprising a propellant heat exchanger, an expander and a condenser, and one or more heat exchangers comprising a heat medium for transferring waste heat from a combustion device to ORC propellant in the propellant heat exchanger for ORC operation;

receiving, via a control circuit comprising a predictive module, operational parameters trained on a neural network using node-based pattern classification and regression configured to operate the thermal energy recovery system toward configured target operational values based on operational conditions comprising waste heat recovery and secondary power generation from the ORC, for maximizing net power output in the system, processing, via the control circuit, the sensor data to evaluate whether the thermal energy recovery system is projected to deviate from the target operational values within a configured time period; and transmitting, via the control circuit, control signals to dynamically modify operation of the thermal energy recovery system of the system such that further produced system sensor data meets the target operational values, wherein the control signals are configured to adjust thermal or operational conditions by modifying heat input and heat extraction out of at least two thermal sources comprising thermal fluids, jacket water, exhaust and/or ORC propellant to meet the target operational values.

10. The method of claim 9, wherein the operational parameters comprise one or more of ORC operational parameters, thermo-electric generator (TEG) operational parameters, engine operational parameters, compressor operational parameters and general operational parameters, wherein the ORC operational parameters comprise one or more of:

power generated by the expander, expander speed, ORC system parasitic loads, ORC propellant temperatures throughout an ORC process, ORC propellant pressures throughout the ORC process, ORC mass flow rate of propellant working fluid, and thermal fluid temperature and/or flow rates entering and exiting the ORC, wherein the TEG operational parameters comprise one or more of:

TEG power generation, engine jacket water entering and exiting the TEG, engine exhaust temperature entering and exiting the TEG, and thermal fluid temperature entering and exiting the TEG, wherein the engine operational parameters comprise one or more of:

engine speed, engine load, engine torque, engine parasitic loads, radiator fan speed, radiator fan load, engine jacket water temperatures, engine jacket water flow rate, engine jacket water discharge from engine temperature, engine jacket water return to engine temperature, engine jacket water discharge from radiator temperature, engine jacket water discharge to radiator temperature, engine exhaust flow rate, and engine exhaust temperature, wherein the compressor operational parameters comprise one or more of:

compressor flow rate, compressor temperatures in and/or out of each stage of compression, compressor jack shaft speed, compressor jack shaft torque, and wherein the general operational parameters throughout the system comprise one or more of:

thermal fluid temperatures pressures and/or flow rates, engine jacket water temperatures pressures and/or flow rates, engine exhaust temperatures pressures and/or mass flow rates, propellant temperatures pressures and/or flow rates, control valve position information, electric drive motor speed, electric drive motor torque, pump flow rates and/or pressures, generator output, and ambient air temperature.

11. The method of claim 9, further comprising providing cooling to the system via at least one of the radiator and/or the condenser of the ORC to provide a steady temperature differential to a thermo-electric generator (TEG).

12. The method of claim 9, wherein the operational parameters are configured as a predictive model comprising one or more instances based on one or more vectors of the neural network representing features of an input and a corresponding output relating to one or more target operational values.

13. The method of claim 12, wherein the predictive model comprises classifier data associated with pattern recognition performed on previous sensor data.

14. The method of claim 13, wherein the control circuit is configured to map the produced sensor data with the classifier data.

15. The method of claim 9, wherein the control signals are configured to control thermal energy from a thermal energy source and ORC in the system to meet the target operational values without disrupting the operation of the system.

16. The method of claim 9, wherein the control signals are configured to control flow paths in the system to either input heat into, or take heat out of the exhaust and/or thermal fluids to meet the target operational values without disrupting the operation of the system.

17. A system for collection and conversion of thermal energy to mechanical and/or electric energy, the system comprising:

a thermal energy recovery system for waste heat recovery, comprising an Organic Rankine Cycle (ORC) comprising a propellant heat exchanger, an expander, a condenser, and one or more heat exchangers comprising a heat medium for transferring waste heat from a combustion device to ORC propellant in the propellant heat exchanger for ORC operation;

sensors, operatively coupled to the thermal energy recovery system and the waste heat recovery system, the sensors being configured to produce system sensor comprising operational data associated with environmental conditions and ORC-based operational parameters;

a control circuit comprising a predictive module, wherein the predictive module comprises operational parameters for a predictive model trained on a neural network configured to model nonlinear and time-dependent ORC system behavior, the modeling comprising generating vector-based representations of sensor-derived input features and associating such representations with predicted operational outputs corresponding to one or more target operational values, the predictions reflecting waste-heat recovery conditions and secondary power generation from the ORC, for maximizing net power output in the system, wherein the control circuit is configured to receive and process the produced sensor data to evaluate whether the sensor data is projected to deviate from the target operational values within a configured time period, and wherein the control circuit is configured to transmit control signals to dynamically modify operation of the thermal energy recovery system such that further produced system sensor data meets the target operational values, wherein the control signals are configured to adjust thermal or operational conditions by modifying heat input and heat extraction of at least two thermal sources comprising thermal fluids, jacket water, exhaust and/or ORC propellant to meet the target operational values.

18. The system of claim 17, wherein the operational parameters comprise one or more of:

power generated by the expander, expander speed, ORC system parasitic loads, ORC propellant temperatures throughout an ORC process, ORC propellant pressures throughout the ORC process, ORC mass flow rate of propellant working fluid, ORC flow rate of propellant working fluid, thermal energy transferred into and/or out of the system, control valve position information, an electric drive motor speed, an electric drive motor torque, pump flow rates and/or pressures, generator output, and ambient air temperature.

19. The system of claim 17, wherein the condenser of the ORC is configured to provide cooling to the system.

20. The system of claim 17, wherein the predictive model comprises classifier data associated with pattern recognition performed on previous sensor data, and wherein the control circuit is configured to map the produced sensor data with the classifier data.

* * * * *